US007926393B2

(12) United States Patent
Hart

(10) Patent No.: US 7,926,393 B2
(45) Date of Patent: Apr. 19, 2011

(54) QUAD WRENCH

(75) Inventor: Herbert G. Hart, Sunnyvale, CA (US)

(73) Assignee: Edison Nation, LLC, Charlotte, NC (US)

( * ) Notice: Subject to any disclaimer, the term of this patent is extended or adjusted under 35 U.S.C. 154(b) by 0 days.

(21) Appl. No.: 12/724,130

(22) Filed: Mar. 15, 2010

(65) Prior Publication Data

US 2010/0229695 A1 Sep. 16, 2010

Related U.S. Application Data

(60) Provisional application No. 61/160,306, filed on Mar. 14, 2009.

(51) Int. Cl.
*B25B 13/06* (2006.01)
*B25B 23/08* (2006.01)

(52) U.S. Cl. ..... 81/124.4; 81/124.3; 81/125.1

(58) Field of Classification Search ..... 81/124.4, 81/119, 121.1, 124.3, 125.1
See application file for complete search history.

(56) References Cited

U.S. PATENT DOCUMENTS

| | | | | |
|---|---|---|---|---|
| 37,865 | A | 3/1863 | Griswold | |
| 151,635 | A | 6/1874 | Uhlinger et al. | |
| 167,368 | A * | 8/1875 | Waitt | 81/124.3 |
| 272,822 | A * | 2/1883 | Womelsdorff | 81/60 |
| D103,579 | S | 3/1937 | McNaught | |
| 2,687,056 | A | 8/1954 | Foor | |
| 3,121,356 | A | 2/1964 | Davis | |
| D278,510 | S | 4/1985 | Schoeberlein | |
| 5,048,379 | A | 9/1991 | Gramera et al. | |
| 5,092,203 | A | 3/1992 | Mader et al. | |
| 5,388,486 | A | 2/1995 | Ruzicka et al. | |
| 5,595,096 | A | 1/1997 | Coffman | |
| 6,112,625 | A * | 9/2000 | Turtle | 81/177.2 |
| 6,131,492 | A * | 10/2000 | Mai | 81/119 |
| 6,918,323 | B2 | 7/2005 | Arnold et al. | |

(Continued)

FOREIGN PATENT DOCUMENTS

JP 62-113977 U 7/1987

(Continued)

OTHER PUBLICATIONS

Information Disclosure Statement (IDS) Letter Regarding Common Patent Application(s), Dated May 17, 2010.

(Continued)

*Primary Examiner* — Hadi Shakeri
(74) *Attorney, Agent, or Firm* — James D. Wright; Chad D. Tillman; Tillman Wright, PLLC

(57) ABSTRACT

A quad wrench has a head including an internal guide, first and second crowns separated by said internal guide, each of said first and second crowns having a plurality of interior faces, and first and second bolt receiving spaces, each bolt receiving space being at least partially defined by an outer surface of said internal guide and some of said plurality of interior faces, and a shank connected to said head. Each bolt receiving space of each crown is configured to correspond to both a first certain size of bolt and a second certain size of bolt such that a bolt of either certain size received in the bolt receiving space can be rotated when force is applied to the shank, and each bolt receiving space of the quad wrench is configured to correspond to two different certain sizes of bolts.

11 Claims, 45 Drawing Sheets

U.S. PATENT DOCUMENTS

| | | | | |
|---|---|---|---|---|
| D524,615 | S * | 7/2006 | Albertson | D8/29 |
| 7,340,983 | B2 | 3/2008 | Ling et al. | |
| 2003/0079570 | A1 * | 5/2003 | Chen | 81/60 |
| 2007/0277652 | A1 | 12/2007 | Tuan-Mu | |
| 2008/0105093 | A1 | 5/2008 | Hart | |
| 2008/0148907 | A1 | 6/2008 | Ling et al. | |
| 2009/0301270 | A1 | 12/2009 | Hart | |
| 2010/0000378 | A1 | 1/2010 | Hart | |
| 2010/0275739 | A1 | 11/2010 | Hart | |

FOREIGN PATENT DOCUMENTS

| | | | |
|---|---|---|---|
| JP | 02-143169 | U | 12/1990 |
| JP | 03-027731 | U9 | 5/1996 |
| WO | 2010107676 | A2 | 9/2010 |
| WO | 2010107676 | A9 | 11/2010 |

OTHER PUBLICATIONS

Information Disclosure Statement (IDS) Letter Regarding Common Patent Application(s), dated Sep. 22, 2010, U.S. Appl. No. 12/495,689; U.S. Appl. No. 12/542,095; U.S. Appl. No. 12/836,960. "International Search Report" and "Written Opinion" of the International Search Authority (Korean Intellectual Property Office) in Edison Nation, LLC International Patent Application Serial No. PCT/US2010/027216, dated Oct. 28, 2010, 10 pages.

* cited by examiner

1100

| top and bottom perimeter of: | | | | | | | | | | | | | |
|---|---|---|---|---|---|---|---|---|---|---|---|---|---|
| interior face 1112 | Arc Length (mm) | 10.464 | 9.926 | 8.913 | 7.884 | 7.112 | 9.926 | 6.383 | 5.334 | 4.63 | 4.202 | 3.557 | 2.663 |
| | Chord Length (mm) | 10.427 | 9.877 | 8.875 | 7.853 | 7.073 | 9.877 | 6.367 | 5.31 | 4.608 | 4.184 | 3.541 | 2.65 |
| | Diameter (mm) | 71.054 | 57.788 | 55.756 | 51.006 | 38.841 | 57.788 | 52.151 | 32.775 | 28.995 | 26.451 | 21.807 | 15.711 |
| | Angle (deg) | 16.876 | 19.683 | 18.318 | 17.713 | 20.984 | 19.683 | 14.026 | 18.649 | 19.088 | 18.202 | 18.691 | 19.423 |
| curved face 1114 | Arc Length (mm) | 1.027 | 1.075 | 1.065 | 1.081 | 1.109 | 1.075 | 0.497 | 0.546 | 0.542 | 0.534 | 0.55 | 0.565 |
| | Chord Length (mm) | 1.009 | 1.055 | 1.045 | 1.06 | 1.087 | 1.055 | 0.489 | 0.535 | 0.531 | 0.524 | 0.539 | 0.553 |
| | Diameter (mm) | 3.175 | 3.175 | 3.175 | 3.175 | 3.175 | 3.175 | 1.587 | 1.588 | 1.587 | 1.587 | 1.587 | 1.588 |
| | Angle (deg) | 37.068 | 38.81 | 38.446 | 39.022 | 40.029 | 38.809 | 35.854 | 39.383 | 39.118 | 38.519 | 39.676 | 40.747 |
| planar face 1115 | Length (mm) | 0.62 | 0.444 | 0.279 | 0.335 | 0.151 | 0.444 | 0.307 | 0.25 | 0.088 | 0.108 | 0.138 | 0.021 |

Table 1

FIG. 22

| top and bottom perimeter of: | | | |
|---|---|---|---|
| 1232 | Arc Length (mm) | 5.334 | 7.893 |
| | Chord Length (mm) | 5.311 | 7.853 |
| | Diameter (mm) | 32.78 | 45.397 |
| | Angle (deg) | 18.647 | 19.922 |
| 1234 | Arc Length (mm) | 0.546 | 1.081 |
| | Chord Length (mm) | 0.535 | 1.06 |
| | Diameter (mm) | 1.588 | 3.175 |
| | Angle (deg) | 39.397 | 39.022 |
| 1235 | Length (mm) | 0.25 | 0.335 |
| 1242 | Arc Length (mm) | 3.557 | 6.126 |
| | Chord Length (mm) | 3.541 | 6.106 |
| | Diameter (mm) | 21.807 | 43.907 |
| | Angle (deg) | 18.69 | 15.988 |
| 1244 | Arc Length (mm) | 0.55 | 1.063 |
| | Chord Length (mm) | 0.539 | 1.043 |
| | Diameter (mm) | 1.587 | 3.175 |
| | Angle (deg) | 39.673 | 38.362 |
| 1245 | Length (mm) | 0.138 | 0.183 |
| 1252 | Arc Length (mm) | 3.379 | 6.173 |
| | Chord Length (mm) | 3.366 | 6.152 |
| | Diameter (mm) | 21.81 | 43.908 |
| | Angle (deg) | 17.754 | 16.11 |
| 1254 | Arc Length (mm) | 0.813 | 0.842 |
| | Chord Length (mm) | 0.778 | 0.803 |
| | Diameter (mm) | 1.587 | 1.588 |
| | Angle (deg) | 58.699 | 60.805 |
| 1255 | Length (mm) | 0.593 | n/a |

Table 2

FIG. 23

QUAD WRENCH

CROSS REFERENCE TO RELATED APPLICATIONS

The present application is a U.S. nonprovisional patent application of, and claims priority under 35 U.S.C. §119 (e) to, U.S. provisional application Ser. No. 61/160,306, filed Mar. 14, 2009 ("the '306 application"), which '306 application is hereby incorporated by reference herein.

Additionally, the present application hereby incorporates herein by reference each of the following patent applications and patent application publications: U.S. patent application ser. No. 12/495,689, filed Jun. 30, 2009; U.S. patent application Ser. No. 12/404,304, filed Mar. 14, 2009; U.S. patent application Ser. No. 11/796,350, filed Apr. 26, 2007; U.S. provisional patent application Ser. No. 60/797,190, filed May 2, 2006; U.S. patent application publication no. US/2010/0000378; and U.S. patent application publication no. US/2008/0105093.

BACKGROUND OF THE INVENTION

For many years, traditional wrenches have been widely used. Traditional wrenches are frequently found inconvenient, inefficient, cumbersome and new wrenches are highly demanded. For instance, wrenches having closed openings with planar engagement surfaces often result in stress being applied to a hexagonal fastener and thus cause deformation of the fastener as well as providing inefficient torquing ability. Prior art wrenches having closed openings with curved engagement surfaces are known. See U.S. Pat. No. 4,930,378 to Colvin. Although the prior art wrenches include six-point and twelve-point versions, problems with stress distribution are not resolved. Furthermore, the twelve-point version is configured using either metric or inch sizing, rather than both as in a duplex system. Ruzicka et al. discloses rotary wrenching tools capable of wrenching fastener heads in various measuring systems (U.S. Pat. No. 5,388,486. to Ruzicka et al.), but does not disclose a duplex system for both metric and inch sizes. Heberlie discloses ornamental designs for a double-ended box wrench showing the contour of the wrench heads. U.S. Pat. No. D303,069. The invention, however, discloses a double-ended one-sided crown. As the DIYers encounter an increasing number of metric fastener and diminishing percentage of inch sizes, they are required to have two sets of wrenches, for both inch and metric sizes, which are cumbersome, weighty and costly in investment.

SUMMARY OF THE INVENTION

The present invention includes many aspects and features. Moreover, while many aspects and features relate to, and are described in, the context of a wrench, the present invention is not limited to use only in the context of a wrench, as will become apparent from the following summaries and detailed descriptions of aspects, features, and one or more embodiments of the present invention.

An aspect of the present invention relates to a dual wrench. The dual wrench includes a head comprising an internal guide, first and second crowns separated by said internal guide, each of said first and second crowns comprising a plurality of interior faces, and a bolt receiving space defined by said plurality of interior faces and an outer surface of said internal guide; a shank connected to said head; wherein each bolt receiving space of each crown is configured to correspond to both a first certain size of bolt and a second certain size of bolt such that a bolt of either certain size received in the bolt receiving space can be rotated when force is applied to the shank, and each bolt receiving space of the dual wrench is configured to correspond to two different certain sizes of bolts.

In a feature of this aspect of the invention, the dual wrench further includes a second head, the second head comprising an internal guide; and first and second crowns separated by said internal guide, each of said first and second crowns comprising a plurality of interior faces, and a bolt receiving space defined by said plurality of interior faces and an outer surface of said internal guide; wherein each bolt receiving space of each crown of the second head is configured to correspond to both a first certain size of bolt and a second certain size of bolt such that a bolt of either certain size received in the bolt receiving space can be rotated when force is applied to the shank, and the shank connects together the first said head and said second head.

In a feature of this aspect of the invention, each first certain size of bolt is an SAE bolt and each second certain size of bolt is a metric bolt.

In a feature of this aspect of the invention, each bolt receiving space of each crown is configured to correspond to both a first certain size of bolt and a second certain size of bolt such that when a bolt of either certain size is received in the bolt receiving space and the head the crown is a part of is rotated by applying force to the shank, force is applied to hex flats of the bolt and the bolt is rotated.

In a feature of this aspect of the invention, said internal guide is a tapered internal guide.

In a feature of this aspect of the invention, said internal guide includes an aperture defined therethrough.

In a feature of this aspect of the invention, said internal guide is a tapered internal guide, and wherein said internal guide includes an aperture defined therethrough.

In a feature of this aspect of the invention, the aperture is defined therethrough in a direction generally orthogonal to the direction of tapering.

In a feature of this aspect of the invention, each interior face is curved inwards towards a horizontal midpoint.

In a feature of this aspect of the invention, said plurality of interior faces consists of six interior faces.

In a feature of this aspect of the invention, said six interior faces are joined by six corner sections.

In a feature of this aspect of the invention, each corner section comprises two curved faces joined by a planar face.

In a feature of this aspect of the invention, said bolt receiving space of said first crown is defined by said plurality of interior faces of said first crown and an upper outer surface of said internal guide.

In a feature of this aspect of the invention, said upper outer surface of said internal guide is planar.

In a feature of this aspect of the invention, said bolt receiving space of said second crown is defined by said plurality of interior faces of said first crown and a lower outer surface of said internal guide.

In a feature of this aspect of the invention, both said upper outer surface and said lower outer surface of said internal guide are planar.

An aspect of the present invention relates to a dual wrench. The dual wrench includes a head comprising first and second opposing crowns, each crown including a plurality of lobes, an aperture defined therethrough, a rim surrounding the periphery of said aperture, said rim having an upper surface defining an upper lip and a lower surface defining a lower lip, a first bolt receiving space defined by said first crown and said upper lip, and a second bolt receiving space defined by said second crown and said lower lip; a shank connected to said head.

In a feature of this aspect of the invention, each bolt receiving space of each crown is configured to correspond to both a first certain size of bolt and a second certain size of bolt such that a bolt of either certain size received in the bolt receiving space can be rotated when force is applied to the shank, and each bolt receiving space of the dual wrench is configured to correspond to two different certain sizes of bolts.

In a feature of this aspect of the invention, each first certain size of bolt is an SAE bolt and each second certain size of bolt is a metric bolt.

An aspect of the present invention relates to a dual wrench. The dual wrench includes first and second heads, each head comprising a tapered internal guide, first and second crowns separated by said tapered internal guide, each of said first and second crowns comprising a plurality of lobes, and a bolt receiving space defined by said plurality of lobes and an outer surface of said tapered internal guide; a shank connecting together said first and second heads; wherein each bolt receiving space of each crown is configured to correspond to both a first certain size of bolt and a second certain size of bolt such that when a bolt of either certain size is received in the bolt receiving space of the crown, corners of the bolt are spaced from the crown and hex flats of the bolt are generally abutted by lobes of the crown such that when the head the crown is a part of is rotated by applying force to the shank, force is applied to the bolt at hex flats of the bolt rather than at corners of the bolt, and each bolt receiving space of the dual wrench is configured to correspond to two different certain sizes of bolts.

An aspect of the present invention relates to a quad wrench. The quad wrench includes a head comprising an internal guide, first and second crowns separated by said internal guide, each of said first and second crowns comprising a plurality of interior faces, and first and second bolt receiving spaces, each bolt receiving space being at least partially defined by an outer surface of said internal guide and some of said plurality of interior faces; a shank connected to said head; wherein each bolt receiving space of each crown is configured to correspond to both a first certain size of bolt and a second certain size of bolt such that a bolt of either certain size received in the bolt receiving space can be rotated when force is applied to the shank, and each bolt receiving space of the quad wrench is configured to correspond to two different certain sizes of bolts.

In a feature of this aspect of the invention, the quad wrench further includes a second head, the second head comprising an internal guide; and first and second crowns separated by said internal guide, each of said first and second crowns comprising a plurality of interior faces, and first and second bolt receiving spaces, each bolt receiving space being at least partially defined by an outer surface of said internal guide and some of said plurality of interior faces; wherein each bolt receiving space of each crown of the second head is configured to correspond to both a first certain size of bolt and a second certain size of bolt such that a bolt of either certain size received in the bolt receiving space can be rotated when force is applied to the shank, and the shank connects together the first said head and said second head.

In a feature of this aspect of the invention, said plurality of interior faces consists of a first group of four interior faces that are generally identical to one another, a second group of two interior faces that are generally identical to one another but generally not identical to the interior faces of the first group, and a third group of two interior faces that are generally identical to one another but generally not identical to the interior faces of the first or second groups.

In a feature of this aspect of the invention, said interior faces are joined by ten corner sections.

In a feature of this aspect of the invention, said ten corner sections consist of a first group of five corner sections that are generally identical to one another, a second group of three corner sections that are generally identical to one another but generally not identical to the corner sections of the first group, and a third group of two corner sections that are generally identical to one another but generally not identical to the corner sections of the first or second groups.

In a feature of this aspect of the invention, each corner section of said first group of corner sections consists of two curved faces joined by a planar face.

In a feature of this aspect of the invention, each corner section of said second group of corner sections consists of two curved faces joined by a planar face.

In a feature of this aspect of the invention, each corner section of said third group of corner sections consists of a curved face.

In a feature of this aspect of the invention, each corner section of said third group of corner sections consists of a curved face and a planar face.

In a feature of this aspect of the invention, each corner section of said first group of corner sections comprises two curved faces joined by a planar face.

In a feature of this aspect of the invention, each corner section of said second group of corner sections comprises two curved faces joined by a planar face.

In a feature of this aspect of the invention, each corner section of said third group of corner sections comprises a curved face.

In a feature of this aspect of the invention, each corner section of said third group of corner sections comprises a curved face and a planar face.

In a feature of this aspect of the invention, each bolt receiving space of said first crown is at least partially defined by an upper outer surface of said internal guide and some of said plurality of interior faces.

In a feature of this aspect of the invention, said upper outer surface of said internal guide is planar.

In a feature of this aspect of the invention, each bolt receiving space of said second crown is at least partially defined by an upper outer surface of said internal guide and some of said plurality of interior faces.

In a feature of this aspect of the invention, both said upper outer surface and said lower outer surface of said internal guide are planar.

An aspect of the present invention relates to a quad wrench. The quad wrench includes a head comprising first and second opposing crowns, each crown including a plurality of lobes, an aperture defined therethrough, a rim surrounding the periphery of said aperture, said rim having an upper surface defining an upper lip and a lower surface defining a lower lip, first and second bolt receiving spaces at least partially defined by said first crown and said upper lip, and first and second bolt receiving spaces at least partially defined by said second crown and said lower lip; and a shank connected to said head.

In a feature of this aspect of the invention, each bolt receiving space of each crown is configured to correspond to both a first certain size of bolt and a second certain size of bolt such that a bolt of either certain size received in the bolt receiving space can be rotated when force is applied to the shank, and each bolt receiving space of the quad wrench is configured to correspond to two different certain sizes of bolts.

An aspect of the present invention relates to a quad wrench having a shank connecting two heads, wherein each head includes two crowns and each crown includes two bolt receiving areas.

An aspect of the present invention relates to a means for engaging sixteen different sized hex bolts.

An aspect of the present invention relates to a method of using a quad wrench.

In an aspect of the present invention, duplex open end and duplex box wrench are paired. Although the head of the open end is significantly smaller in profile than traditional wrenches, the paired crowns and the tapered internal guide adds tangential strength to the wrench head thereby permitting a slight reduction in the thickness of the wall of the both open and box wrenches. More noticeable is the smaller profile of the open end version, which has jaws that are more blunt than those of conventional wrenches. Although the wrenches are paired, the head is less than twice as thick as traditional wrenches. The tapered internal guide increases the offset quality of both end and box crowns.

In an aspect of the present invention, a box crown can be either six or twelve lobes. In one embodiment, the open end has four lobes to contact the fastener and thus distributes the stresses over the four flats of the hex nut. This decreases deformation of the fastener and inefficient torquing ability.

In an aspect of the present invention, a duplex wrench is compact. Compactness enables the duplex wrench to operate in tighter spaces than most traditional wrenches can do. In one or more preferred embodiments, optimum contact is assured on and around the hex while the depth of the crowns is minimized. The tapered internal guide prevents the crown from slipping past the hex.

In an aspect of the present invention, a guide provides perfect alignment between wrench and hex because of the bottoming out of the hex against the guide.

In an aspect of the present invention, a single piece rotary wrenching tool with a tapered internal guide is provides sufficient space for the shaft of a hex bolt to pass through. The operator can nest a hex nut in the crown of the duplex wrench and carry it to a bolt in a different place to reach or to the underside of an object, making dropped and lost nuts less of a problem. The wide range of hexes that can be accommodated by the duplex set makes these unique tools an appealing, light-weight addition to a handy emergency kit or other tool box. With four sizes on each wrench it is easy to pick the right one for the job. This eliminates the need for the user to gather a bundle of wrenches before beginning a job. The concept of combining double crowns with a tapered internal guide can be applied to other related tools, such as drive socket, crow foot, nut driver, and flare nut and ratchet wrenches.

In an aspect of the present invention, two sets of duplex wrenches, both inch and metric, on back to back crowns, provide a do-it-yourselfer (DIYer) with additional benefits. The pairing of inch and metric sizes dramatically reduces the number of wrenches needed to work on both measuring systems. They are not required to have or carry a toolbox of mixed wrenches. The duplex three pack enables a DIY to operate on twenty-four metric and inch size hex fasteners. This also minimizes guesswork on choosing the right size wrench. In one or more preferred embodiments, less weight and metal for construction than would be required for a traditional wrench.

In addition to the aforementioned aspects and features of the present invention, it should be noted that the present invention further encompasses the various possible combinations and subcombinations of such aspects and features.

The above and other objects, features, and advantages of the present invention will become more readily understood and appreciated from a consideration of the following detailed description of the preferred embodiment when taken together with the accompanying drawings, which, however, should not be taken as limitative to the present invention but for elucidation and explanation only.

BRIEF DESCRIPTION OF THE DRAWINGS

One or more preferred embodiments of the present invention now will be described in detail with reference to the accompanying drawings, wherein the same elements are referred to with the same reference numerals, and wherein:

FIG. 22 includes Table 1.

FIG. 23 includes Table 2.

DETAILED DESCRIPTION OF THE INVENTION

Figure 1A:
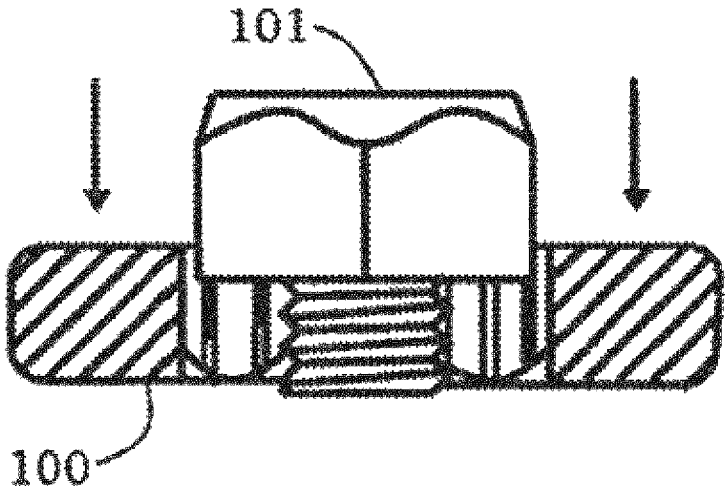
FIG. 1A (PRIOR ART)
FIG. 1A depicts a traditional open end wrench.

As a preliminary matter, it will readily be understood by one having ordinary skill in the relevant art ("Ordinary Artisan") that the present invention has broad utility and application. Furthermore, any embodiment discussed and identified as being "preferred" is considered to be part of a best mode contemplated for carrying out the present invention. Other embodiments also may be discussed for additional illustrative purposes in providing a full and enabling disclosure of the present invention. As should be understood, any embodiment may incorporate only one or a plurality of the above-disclosed aspects of the invention and may further incorporate only one or a plurality of the above-disclosed features. Moreover, many embodiments, such as adaptations, variations, modifications, and equivalent arrangements, will be implicitly disclosed by the embodiments described herein and fall within the scope of the present invention.

Accordingly, while the present invention is described herein in detail in relation to one or more embodiments, it is to be understood that this disclosure is illustrative and exemplary of the present invention, and is made merely for the purposes of providing a full and enabling disclosure of the present invention. The detailed disclosure herein of one or more embodiments is not intended, nor is to be construed, to limit the scope of patent protection afforded the present invention, which scope is to be defined by the claims and the equivalents thereof. It is not intended that the scope of patent protection afforded the present invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection afforded the present invention is to be defined by the appended claims rather than the description set forth herein.

Additionally, it is important to note that each term used herein refers to that which the Ordinary Artisan would understand such term to mean based on the contextual use of such term herein. To the extent that the meaning of a term used herein-as understood by the Ordinary Artisan based on the contextual use of such term-differs in any way from any particular dictionary definition of such term, it is intended that the meaning of the term as understood by the Ordinary Artisan should prevail.

Regarding applicability of 35 U.S.C. §112, ¶6, no claim element is intended to be read in accordance with this statutory provision unless the explicit phrase "means for" or "step for" is actually used in such claim element, whereupon this statutory provision is intended to apply in the interpretation of such claim element.

Furthermore, it is important to note that, as used herein, and "an" each generally denotes "at least one," but does not exclude a plurality unless the contextual use dictates otherwise. Thus, reference to "a picnic basket having an apple" describes "a picnic basket having at least one apple" as well as "a picnic basket having apples." In contrast, reference to "a picnic basket having a single apple" describes "a picnic basket having only one apple."

When used herein to join a list of items, "or" denotes "at least one of the items," but does not exclude a plurality of items of the list. Thus, reference to "a picnic basket having cheese or crackers" describes "a picnic basket having cheese without crackers", "a picnic basket having crackers without cheese", and "a picnic basket having both cheese and crackers." Finally, when used herein to join a list of items, "and" denotes "all of the items of the list." Thus, reference to "a picnic basket having cheese and crackers" describes "a picnic basket having cheese, wherein the picnic basket further has crackers," as well as describes "a picnic basket having crackers, wherein the picnic basket further has cheese."

Referring now to the drawings, one or more preferred embodiments of the present invention are next described. The following description of one or more preferred embodiments is merely exemplary in nature and is in no way intended to limit the invention, its implementations, or uses.

FIG. 1A depicts a traditional open end wrench. A traditional open end wrench 100 slips by when the user applies it on a hex fastener 101.

Figure 1B:
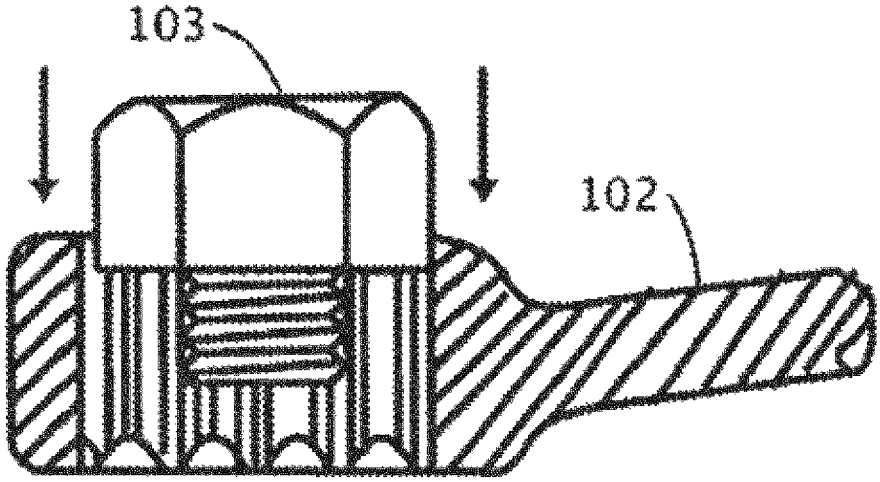
FIG. 1B (PRIOR ART)
FIG. 1B depicts a traditional box wrench.

FIG. 1B depicts a traditional box wrench. A traditional box wrench 102 makes a partial contact with a hex fastener 103.

Figure 2:
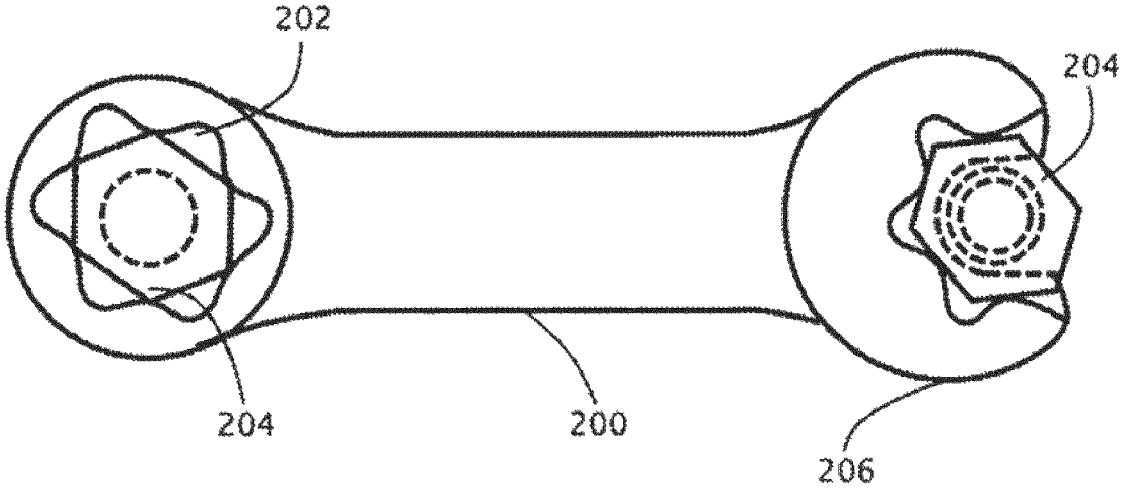
FIG. 2 illustrates a schematic view of a duplex open wrench according to one embodiment of the present invention.

FIG. 2 illustrates a schematic view of a duplex open wrench 200 according to one embodiment of the present invention. In FIG. 2, six inwardly projecting lobes 202 of the same size disposed within a uniform interior of the duplex wrench 200 enable the wrench 200 to exert pressure on flat sides (i.e. flats) of a hexagonal object 204. The head 206 of the duplex open wrench 200 includes a crown having four faces to contact the hexagonal object 204 and thus distribute the stresses over four hex flats of hexagonal object 204.

Figure 3:
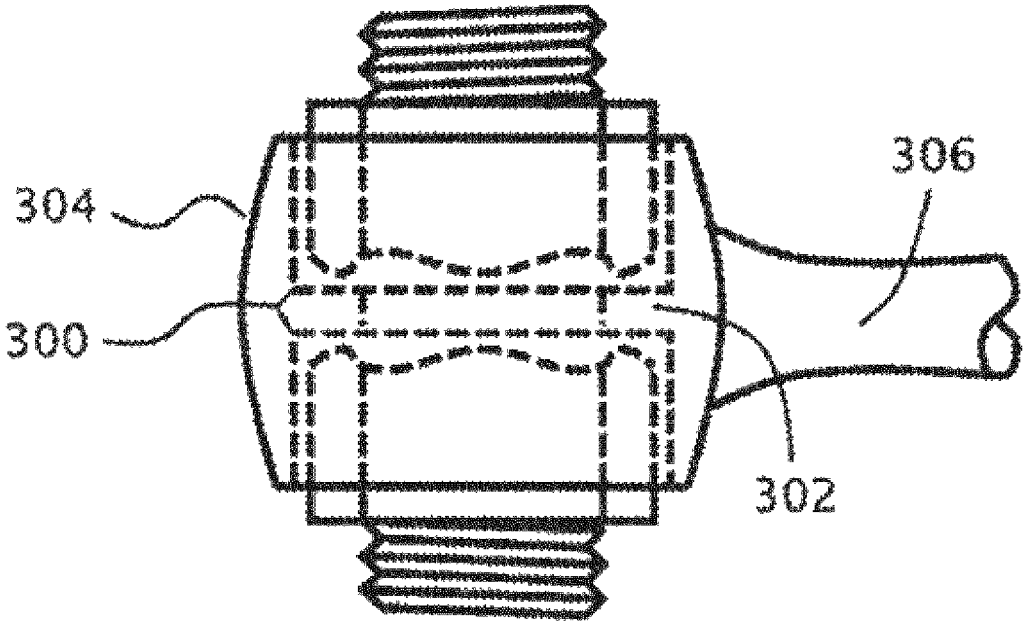
FIG. 3 illustrates a schematic view of a duplex box wrench according to one embodiment of the present invention.

FIG. 3 illustrates a schematic view of a duplex box wrench according to one embodiment of the present invention. A wrench includes a head 304 and a shank 306. The head includes a two-sided crown 300 and a tapered internal guide 302. The paired crowns 300 and the tapered internal guide 302 add strength to the wrench head 304, thereby permitting a slight reduction in the thickness of the box wall of the wrench head 304. Each of the paired crowns 300 can be used as a basket to carry nuts to remote areas or to inverted bolts. The box crown can include either six or twelve lobes.

Figure 4A:
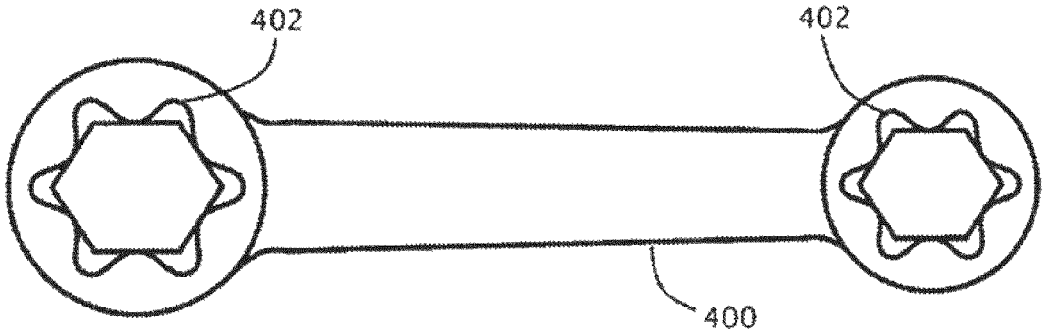
FIGS. 4A, 4B, 4C & 4D depicts a duplex box wrench according to one embodiment of the present invention.

FIG. 4A depicts a schematic view of a duplex box wrench according to one embodiment of the present invention. A wrench with six inwardly projecting lobes 402 of the same size within a uniform interior of the duplex wrench 400 is disclosed.

Figure 4B:
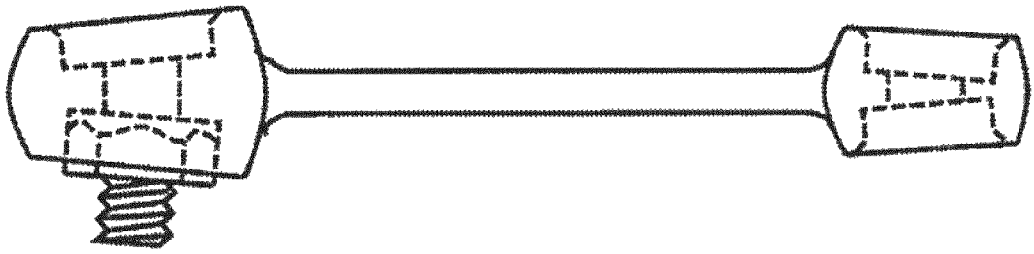
Figure 4C:
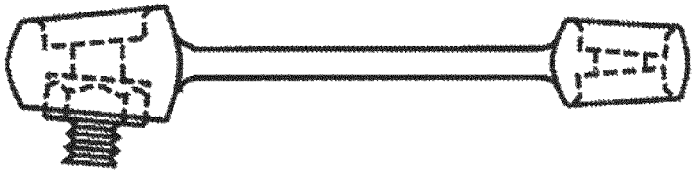
Figure 4D:
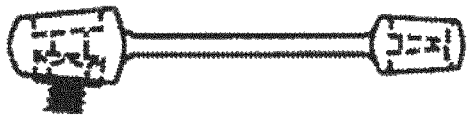

FIGS. 4B through 4D depict duplex box wrench sets according to the present invention.

Figure 5:
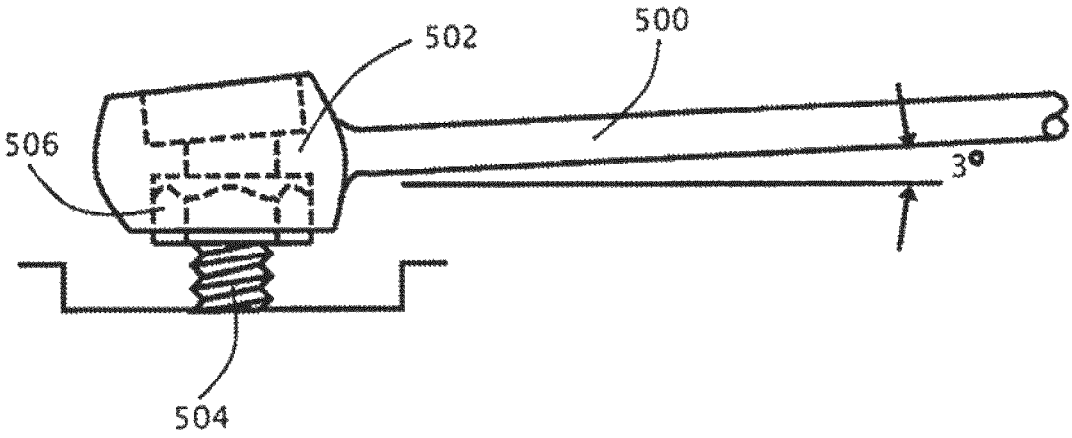
FIG. 5 depicts a duplex wrench according to one embodiment of the present invention.

FIG. 5 depicts a duplex wrench 500 according to one embodiment of the present invention. The tapered internal guide, or lip, 502 increases the offset quality of both box and end crowns. The wrench 500 is configured such that a grip on a hex nut 506 is retained while wrenching the nut on a protruding hex bolt 504. Once contact is made around a hex nut 506 on a protruding bolt 504, the lip 502 keeps the head centered. Ratcheting is done without false torque or tension. In one embodiment, for example, the angle of the tapered internal guide angle relative to the shank is 3°.

Figure 6A:
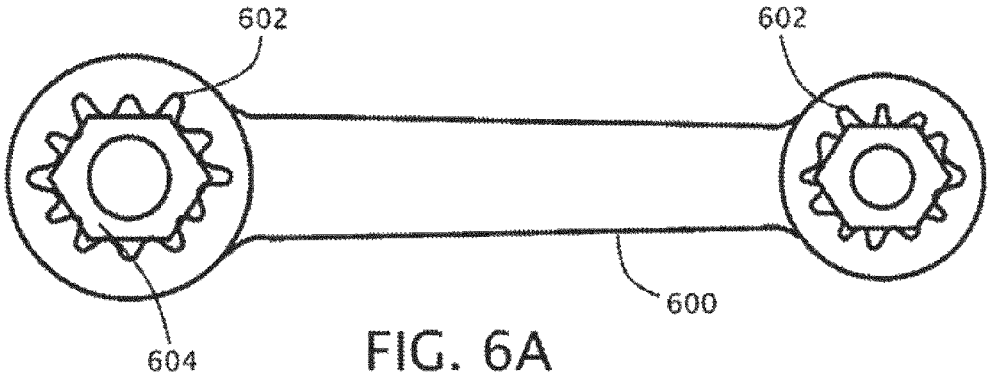
FIGS. 6A, 6B & 6C depict a schematic view of a duplex box wrench according to one embodiment of the present invention.

FIG. 6A depicts a schematic view of a duplex box wrench 600 according to one embodiment of the present invention. A wrench with twelve inwardly projecting lobes 602 of the same size within a uniform interior of the duplex wrench 600 is disclosed.

Figure 6B:
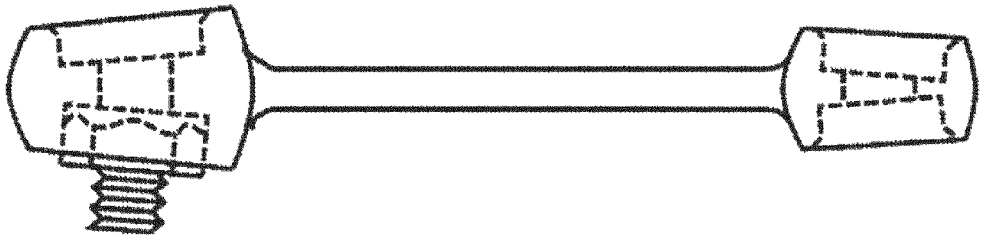
Figure 6C:
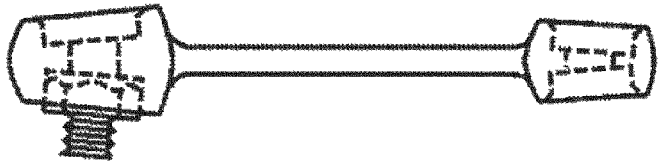

FIGS. 6B through 6D depict duplex box wrench sets according to the present invention.

Figure 7A:
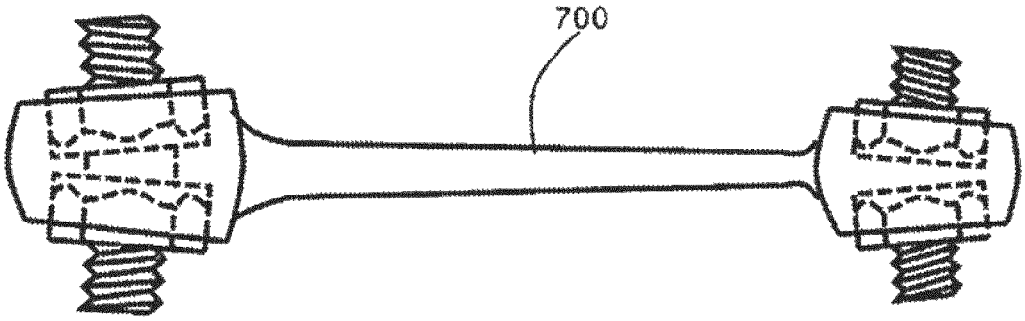
FIG. 7A illustrates a profile view of a duplex wrench having both metric and inch sizes according to one embodiment of the present invention.
Figure 7B:
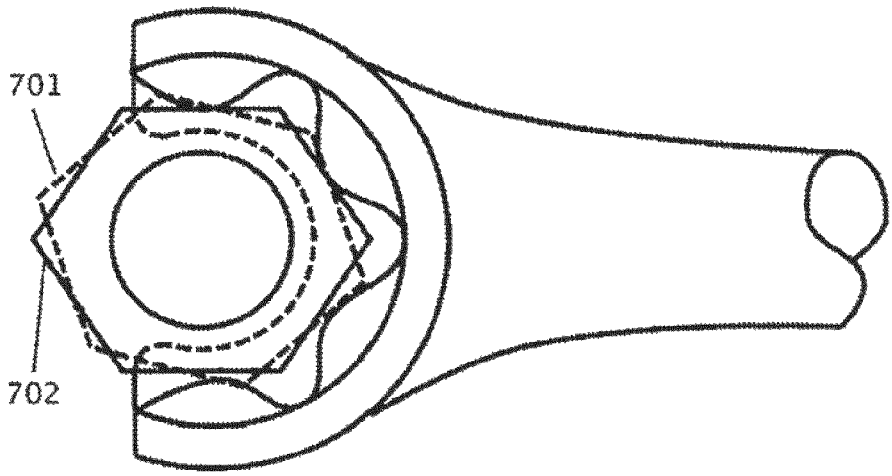
FIG. 7B illustrates a plain view of the metric and inch sizes contacting lobes of the crown.

FIGS. 7A & 7B illustrate a duplex wrench 700 having both metric and inch sizes according to one embodiment of the present invention. A duplex wrench 700 for both inch and metric sizes provides additional benefits. The pairing of inch and metric sizes dramatically reduces the number of wrenches needed to work on both measuring systems. For example a hexagonal object 701 measured in inches and a hexagonal object 702 in centimeters can each be engaged by the same duplex wrench.

Figure 8:
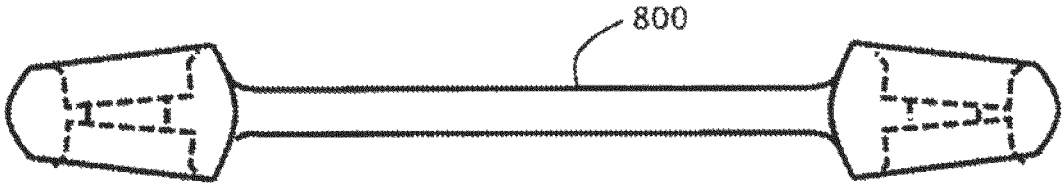
FIG. 8 depicts a duplex wrench having inch sizes according to one embodiment of the present invention.

FIG. 8 depicts a duplex wrench 800 measured in inch sizes according to one embodiment of the present invention. A set of different inch sizes will dramatically reduce the number of wrenches needed to work on inch measuring system.

Figure 9:
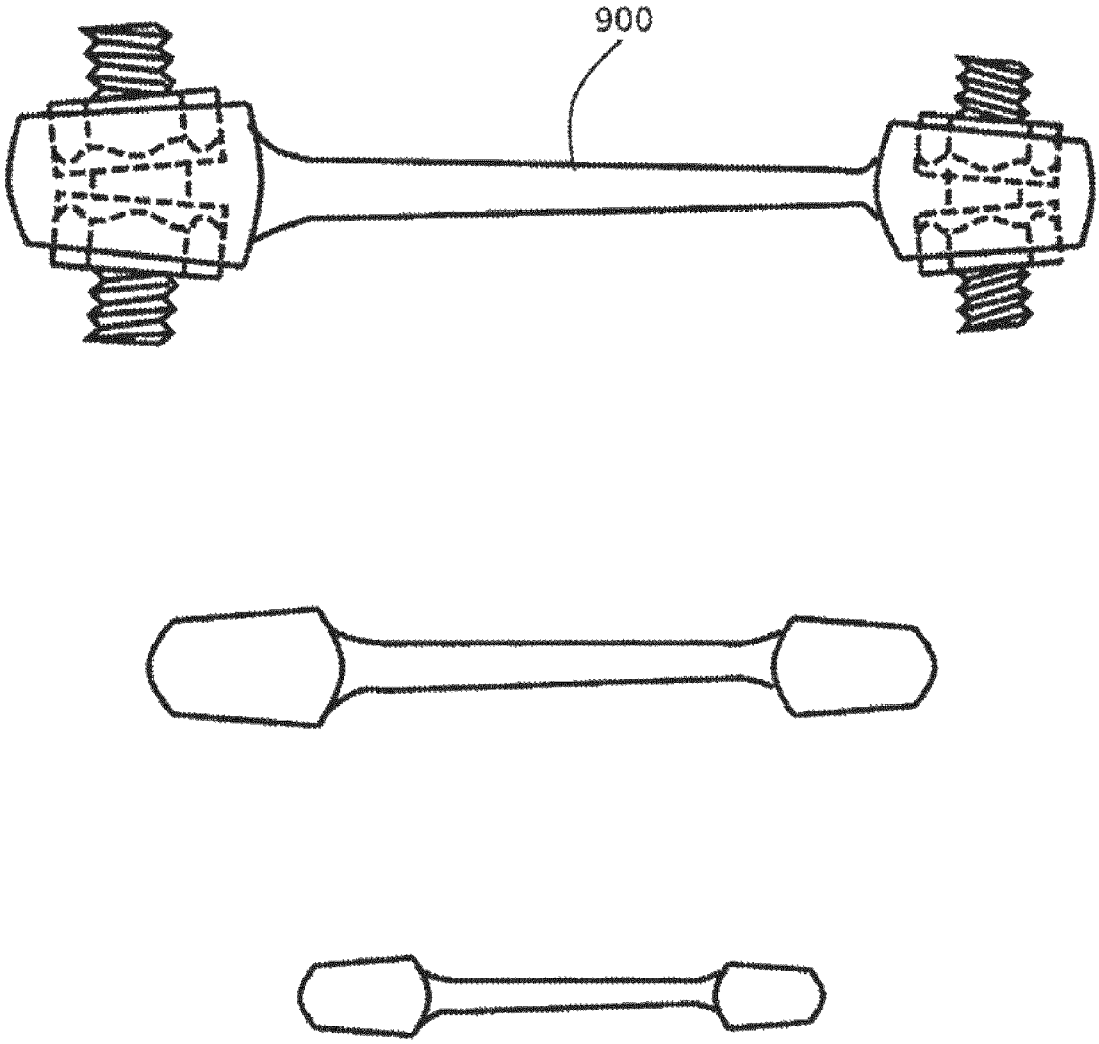
FIG. 9 depicts a duplex wrench having metric sizes according to one embodiment of the present invention.

FIG. 9 depicts a duplex wrench 900 measured using the metric system according to one embodiment of the present invention. A set of different metric sizes will dramatically reduce the number of wrenches needed to work on metric measuring system.

Figure 10A:
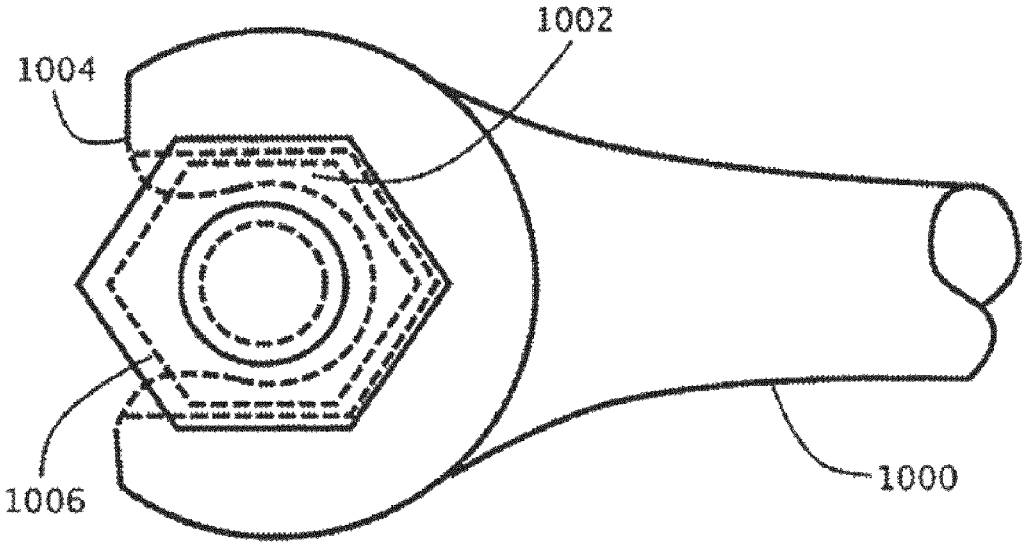
FIGS. 10A & 10B depicts an open end duplex wrench according to one embodiment of the present invention.
Figure 10B:
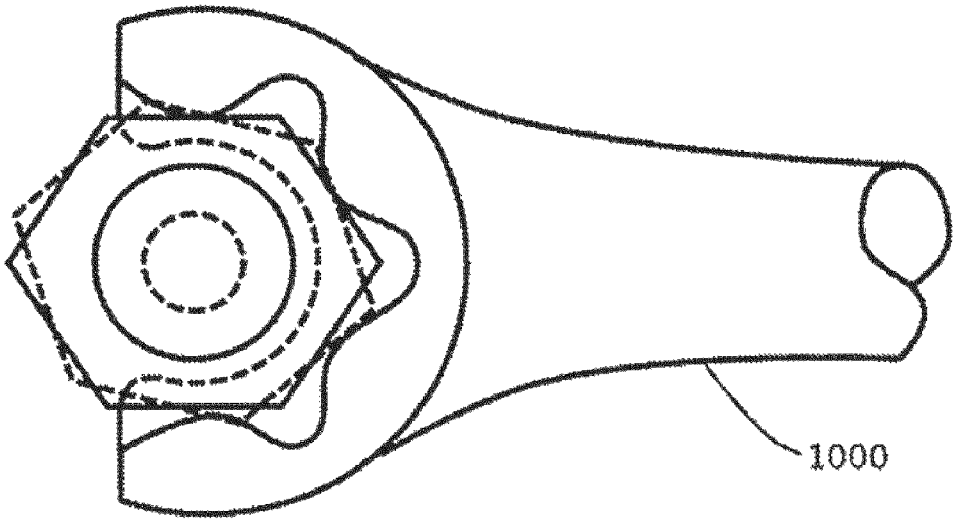

FIGS. 10A & 10B depict an open end duplex wrench 1000 according to one embodiment of the present invention. A tapered internal guide 1002 and jaws with blunt nose 1004 are disclosed. The blunt nose 1004 provides tangential strength to the wrench head when the wrench engages the hex nut 1006.

Dual Wrench

Figure 11:
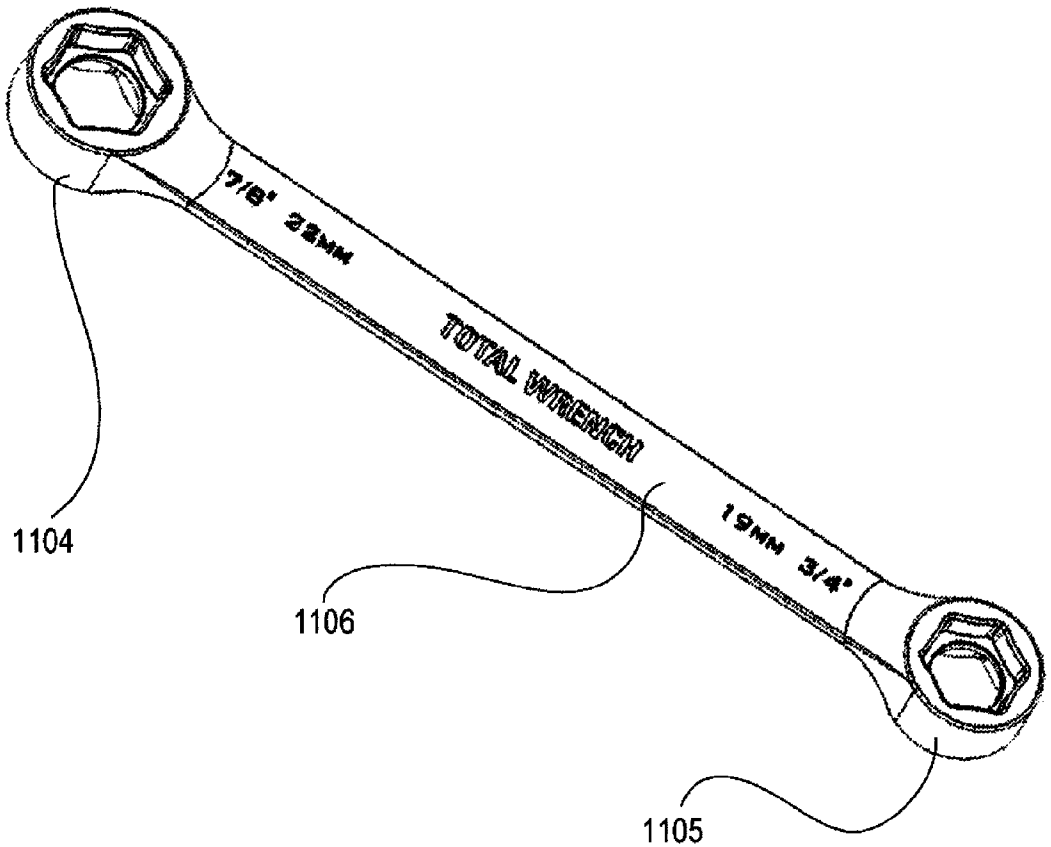
FIG. 11 illustrates a dual wrench in accordance with one or more preferred embodiments of the present invention.
Figure 12:
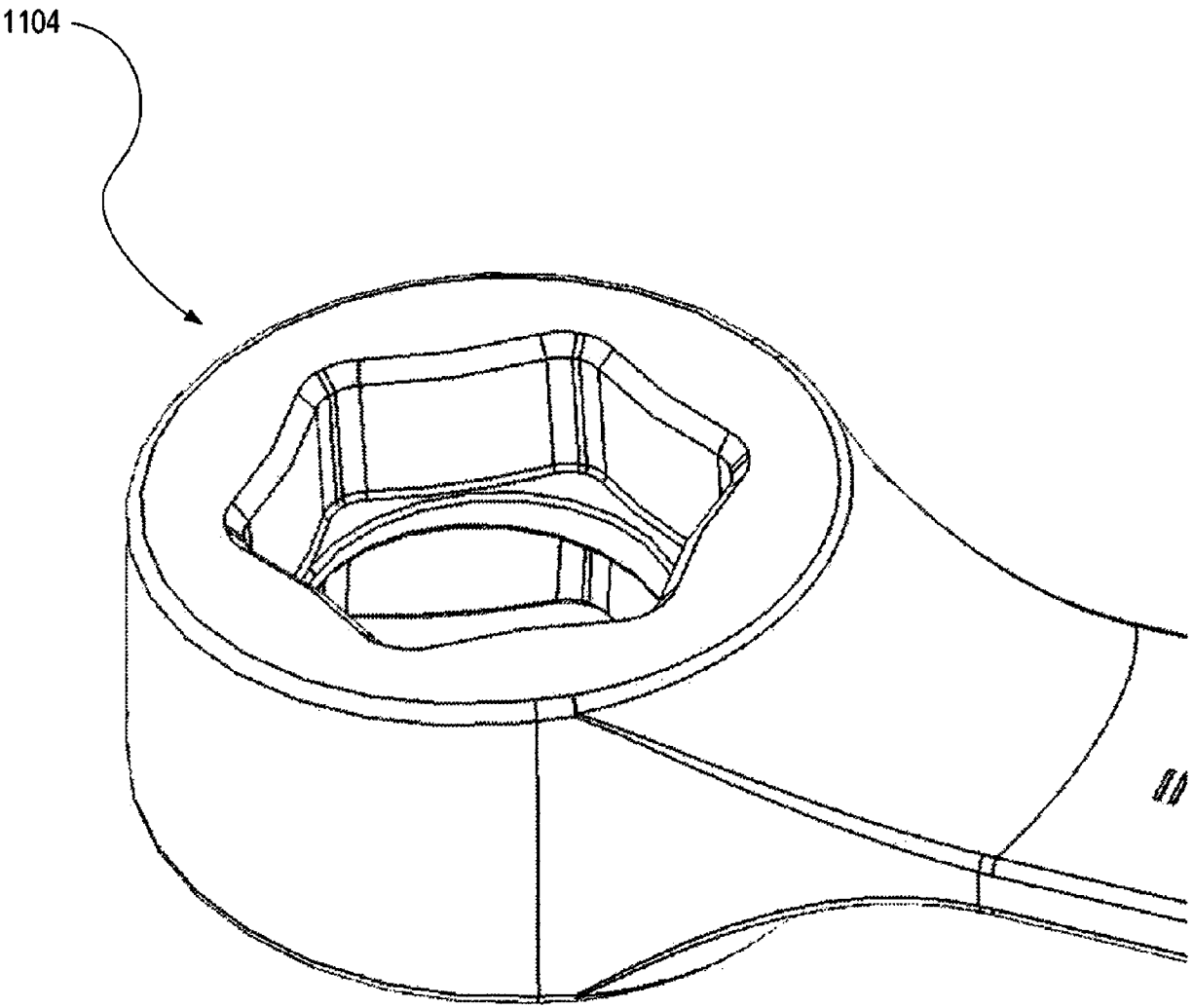
FIG. 12 is a fragmented close-up view of one of the heads of the dual wrench of FIG. 11.

FIG. 11 illustrates a dual wrench 1100 in accordance with one or more preferred embodiments of the present invention. Wrench 1100 comprises two heads 1104,1105 connected by a shank 1106. FIG. 12 is a close-up view of one of the heads 1104.

Figure 13A:
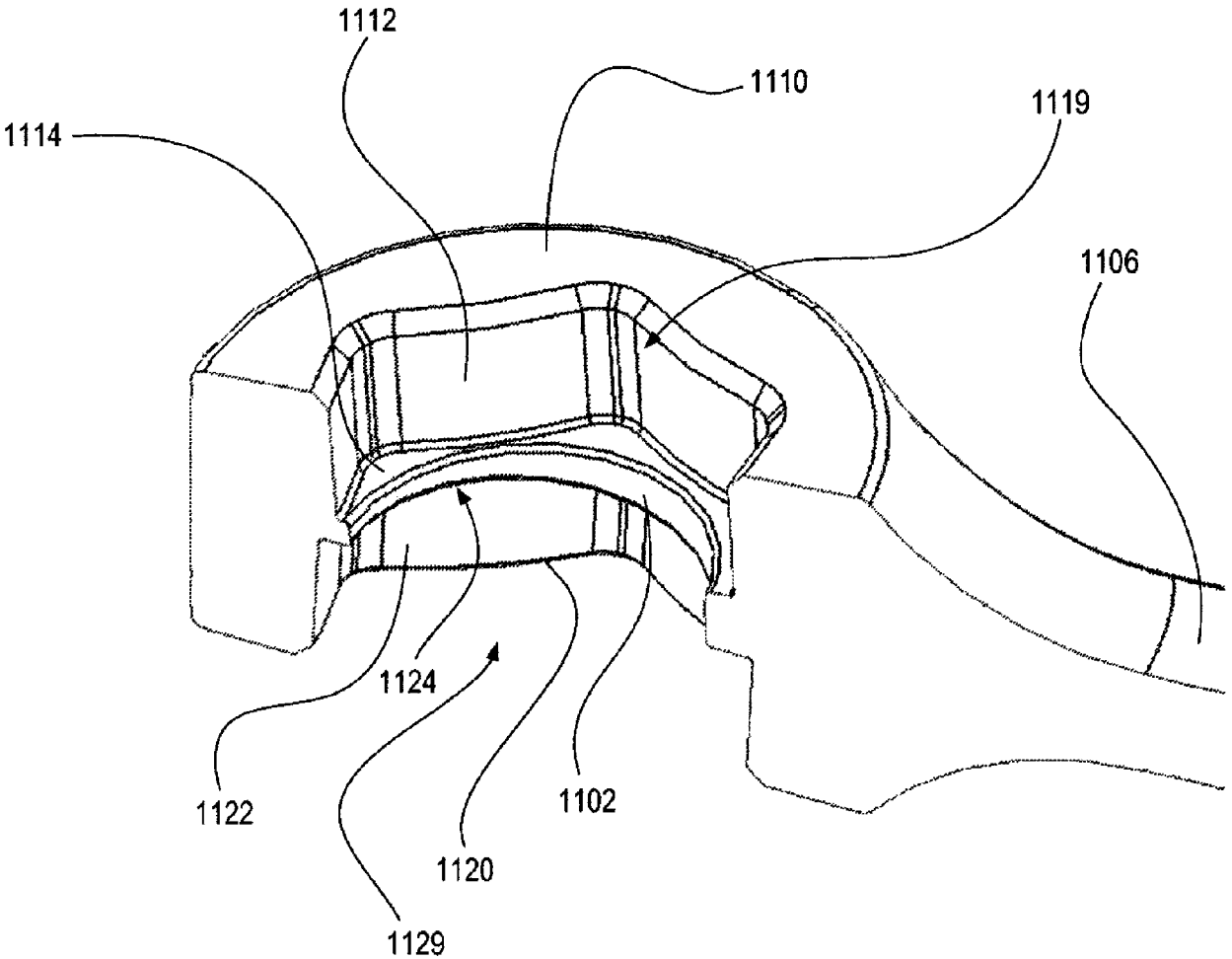
FIG. 13A is a fragmented cross-sectional view of the head of FIG. 12.

As can be seen in FIG. 13A, which is a cross-sectional view of the head 1004 of FIG. 12, each head 1004 includes paired, opposing crowns 1110,1120 generally separated by a tapered internal guide 1102. As its name implies, and as can be seen in FIG. 13A, the tapered internal guide 1102 is tapered in that it is thicker proximate the shank 1106 and tapers off as it moves away therefrom, as is perhaps best seen by comparison of FIG. 13A with FIG. 13C, which figure is a cross-sectional view of FIG. 13B.

Figure 13B:
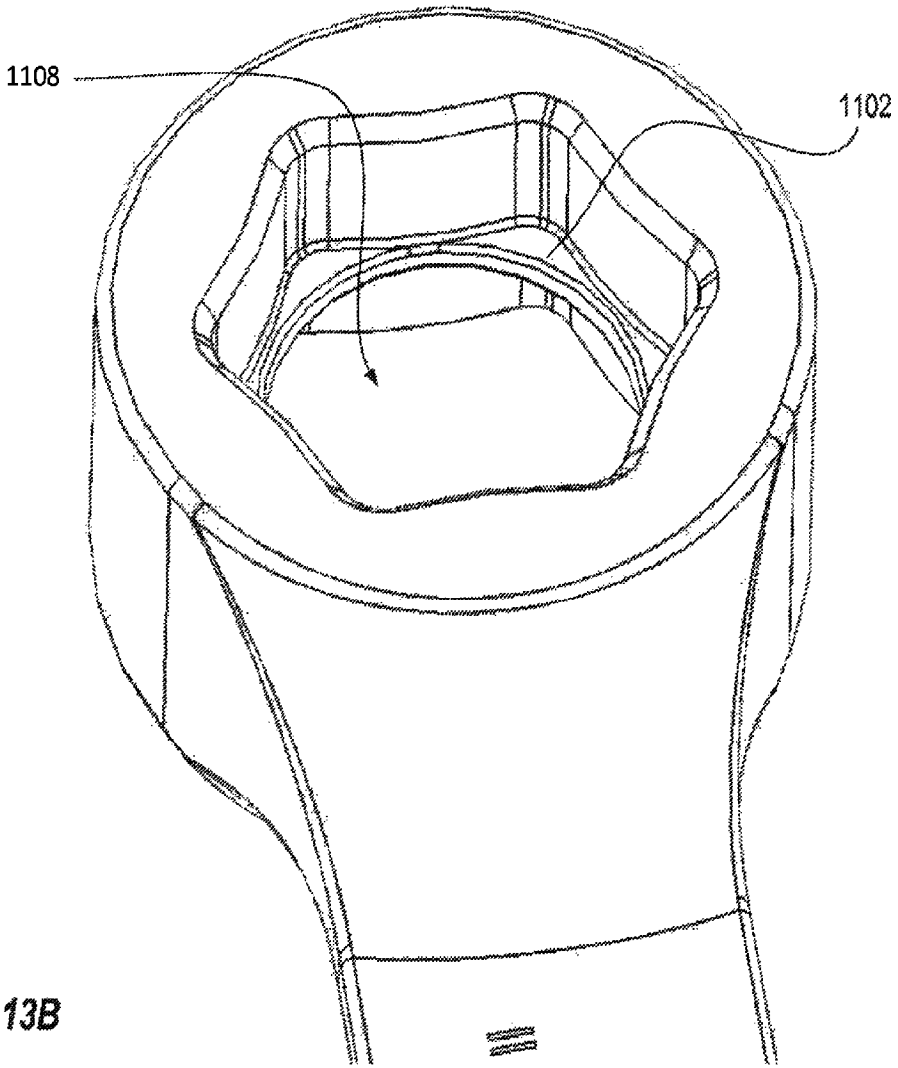
FIG. 13B is a fragmented perspective view of the head of FIG. 12.
Figure 13C:
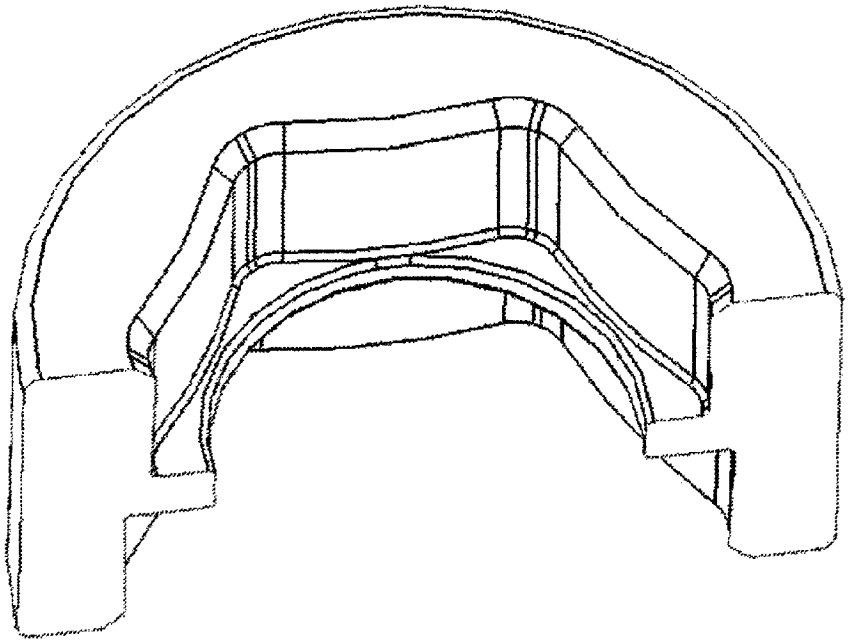
FIG. 13C is a cross-sectional view of FIG. 13B.

It will be appreciated, however, that the internal guide does not have to be tapered as illustrated in FIG. 13A. FIG. 13H illustrates a dual wrench 1300 in accordance with a preferred embodiment of the present invention which includes an internal guide 1302 which, rather than being tapered, is of a generally constant thickness. It will be appreciated then that, although the description herein focuses largely on wrenches having a tapered internal guide, such as tapered internal guide 1102, aspects and features disclosed herein, to the extent practicable, are equally contemplated for use with wrenches having a non-tapered internal guide, such as internal guide 1302.

Returning to wrench 1100, each crown 1110,1120 includes a plurality of interior faces 1112,1122 which, together with an outer planar surface 1114,1124 of the tapered internal guide 1102 (and preferably corner sections as described hereinbelow), define a bolt receiving space 1119,1129. Thus, in FIG. 13A, the bolt receiving space 1119 of the upper crown 1110 is defined by interior faces 1112 and an upper outer planar surface 1114 of the tapered internal guide 1102, while the bolt receiving space 1129 of the lower crown 1120 is defined by interior faces 1122 and a lower outer planar surface 1124 of the tapered internal guide 1102.

Figure 13D:
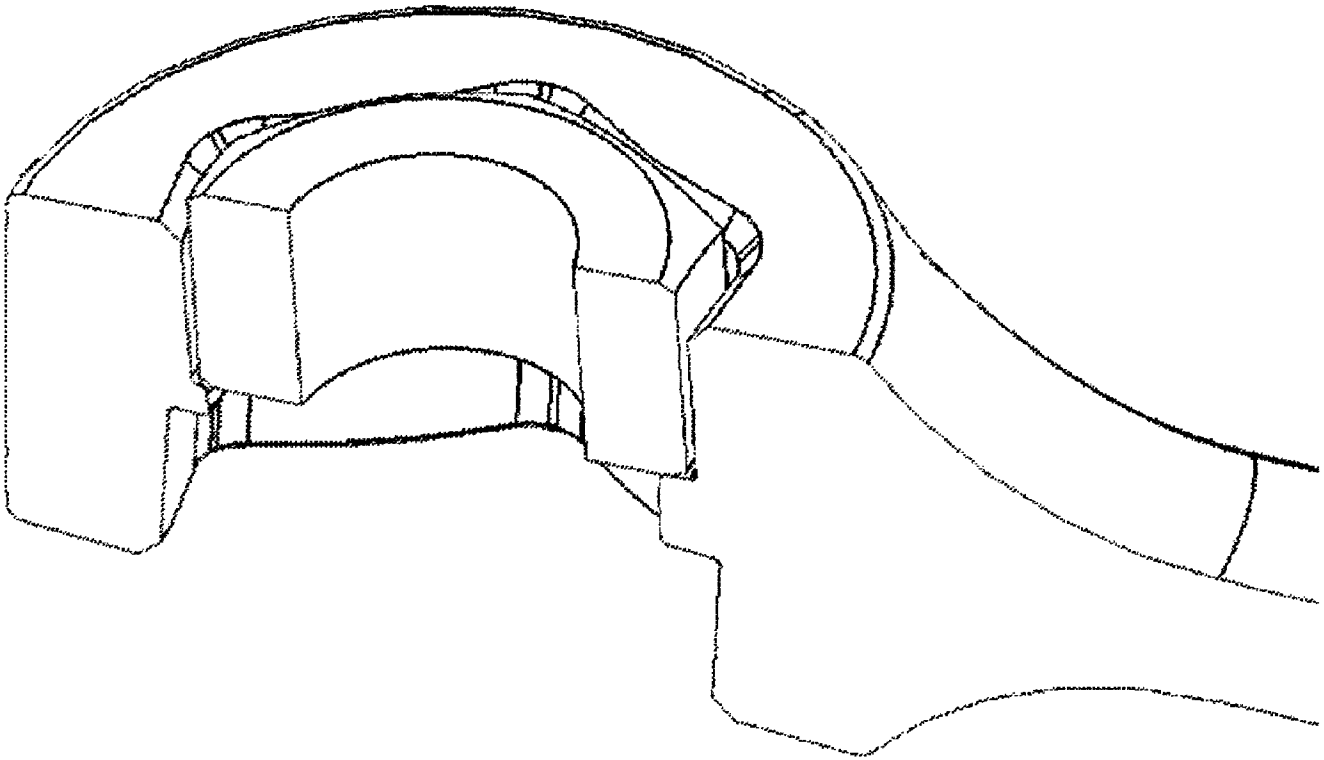
FIGS. 13D-F are fragmented cross-sectional views of the head of FIG. 12 illustrating the receipt of bolts in bolt receiving areas.
Figure 13E:
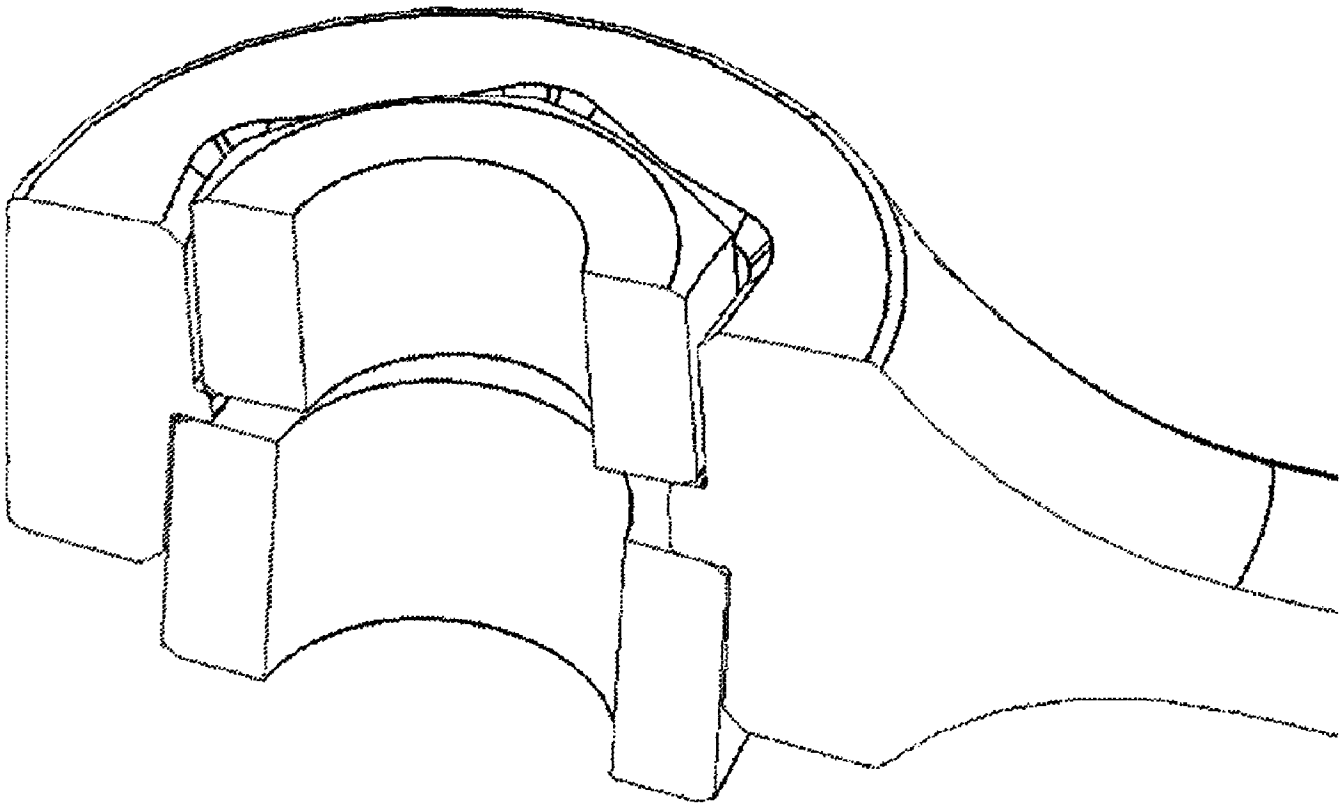
Figure 13F:
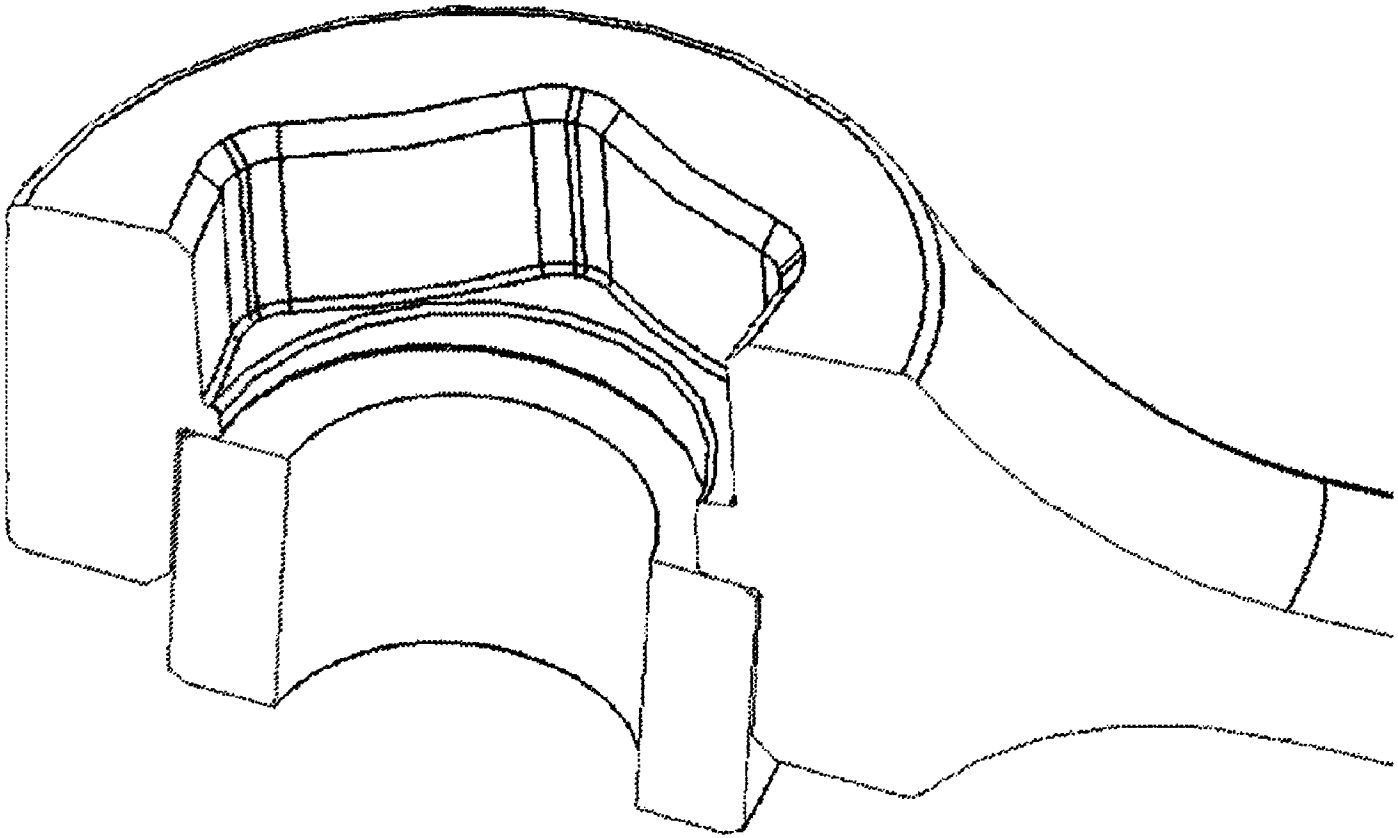
Figure 13G:
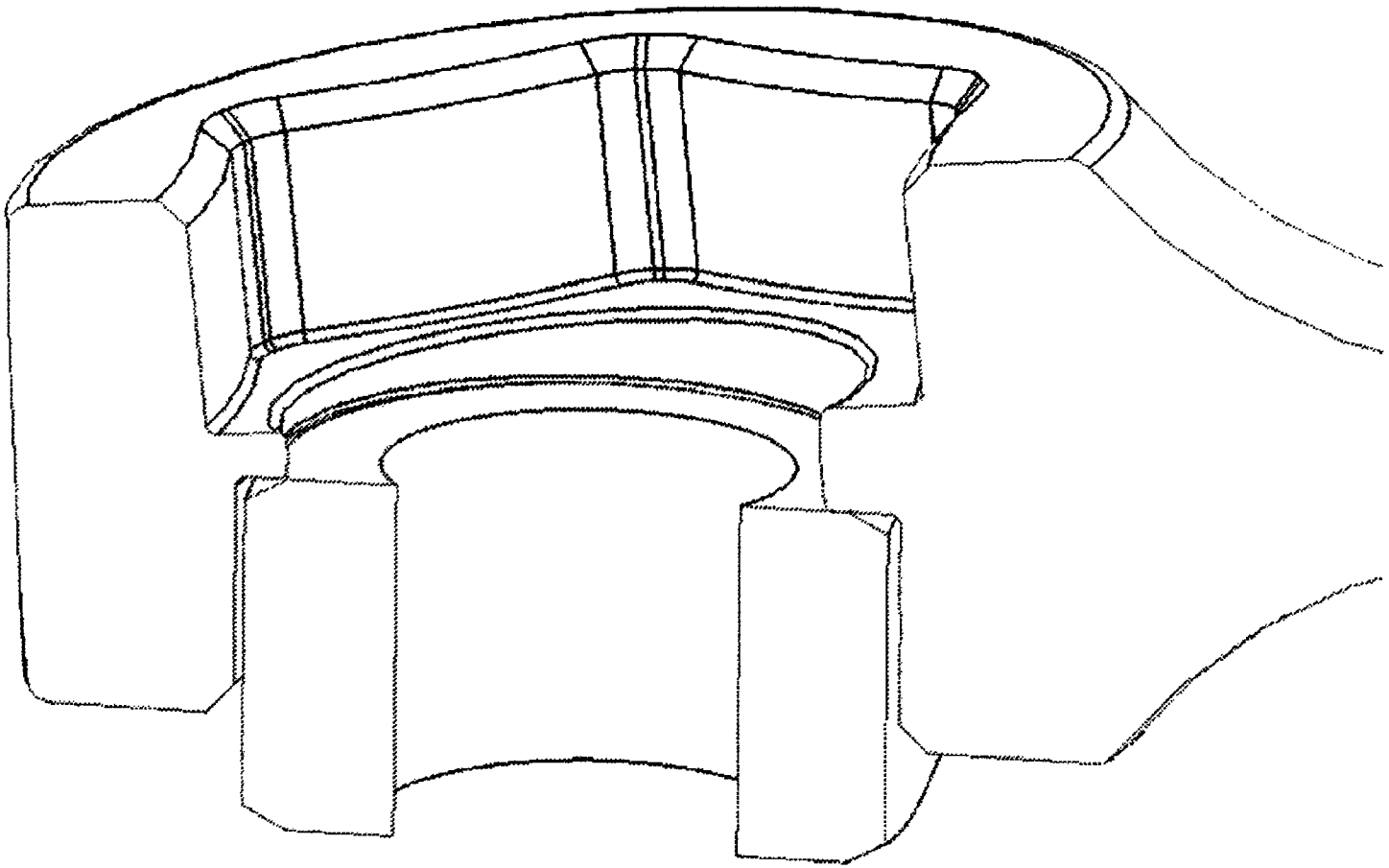
FIG. 13G is a fragmented cross-sectional view of the head of FIG. 12 illustrating an aperture defined therethrough.
Figure 13H:
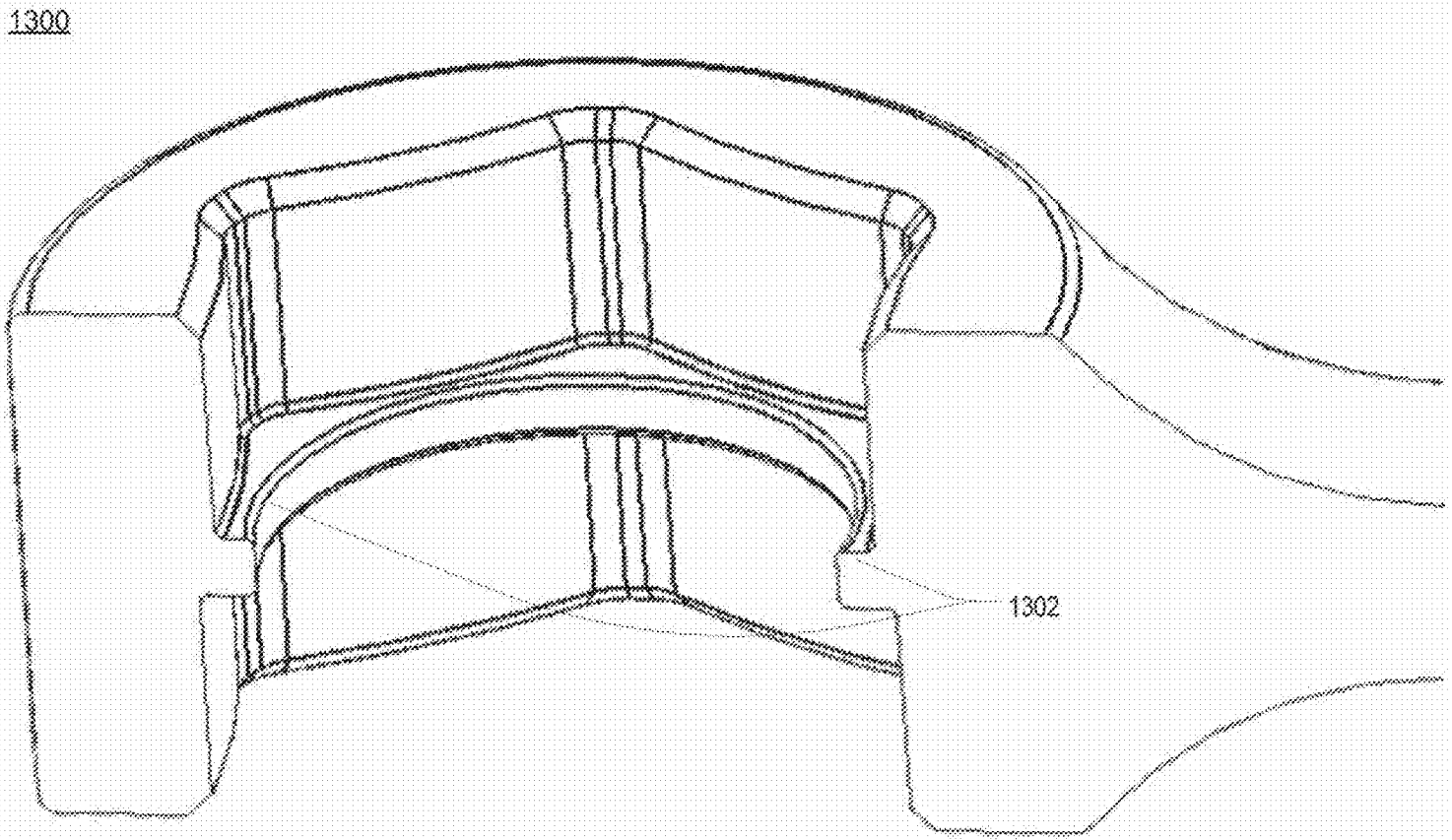
FIG. 13H is a fragmented cross-sectional view of a dual wrench in accordance with one or more preferred embodiments of the present invention.

It will be appreciated that when a bolt is received within the bolt receiving space 1119,1129 of one of the crowns 1110, 1120, tapered internal guide 1102 will prevent the bolt from passing through to the other bolt receiving space 1119,1129, as illustrated in FIGS. 13D-F. The tapered internal guide 1102 can thus be characterized as a lip, or ledge, upon which a bolt can rest. The tapered internal guide 1102 has an aperture 1108 defined therethrough, as can be seen in FIG. 13B. The aperture 1108 is defined therethrough in a direction generally orthogonal to the direction of tapering, as perhaps best illustrated in FIG. 13G.

Figure 14A:
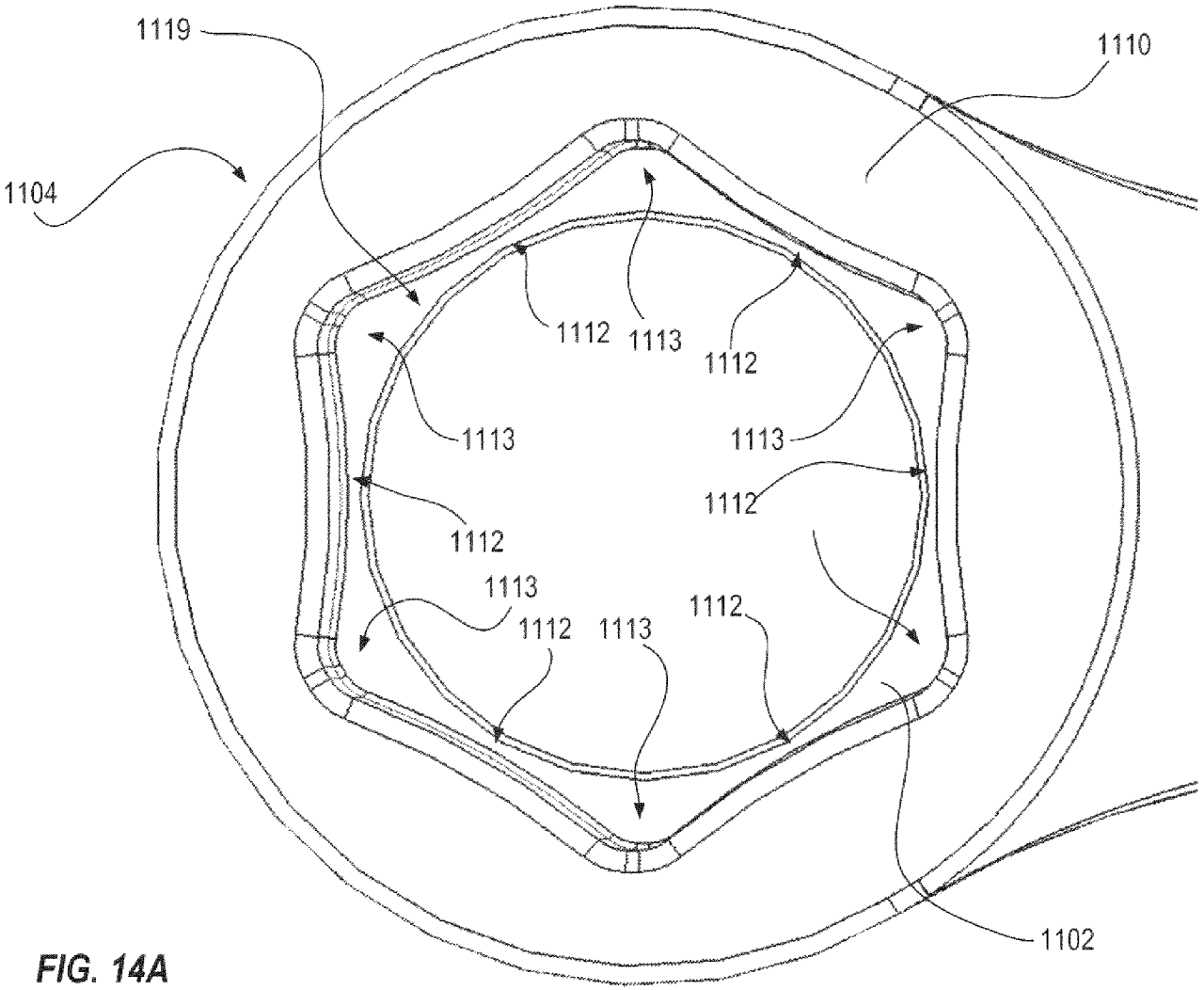
FIG. 14A is a fragmented top perspective view of the head of FIG. 12.
Figure 14B:
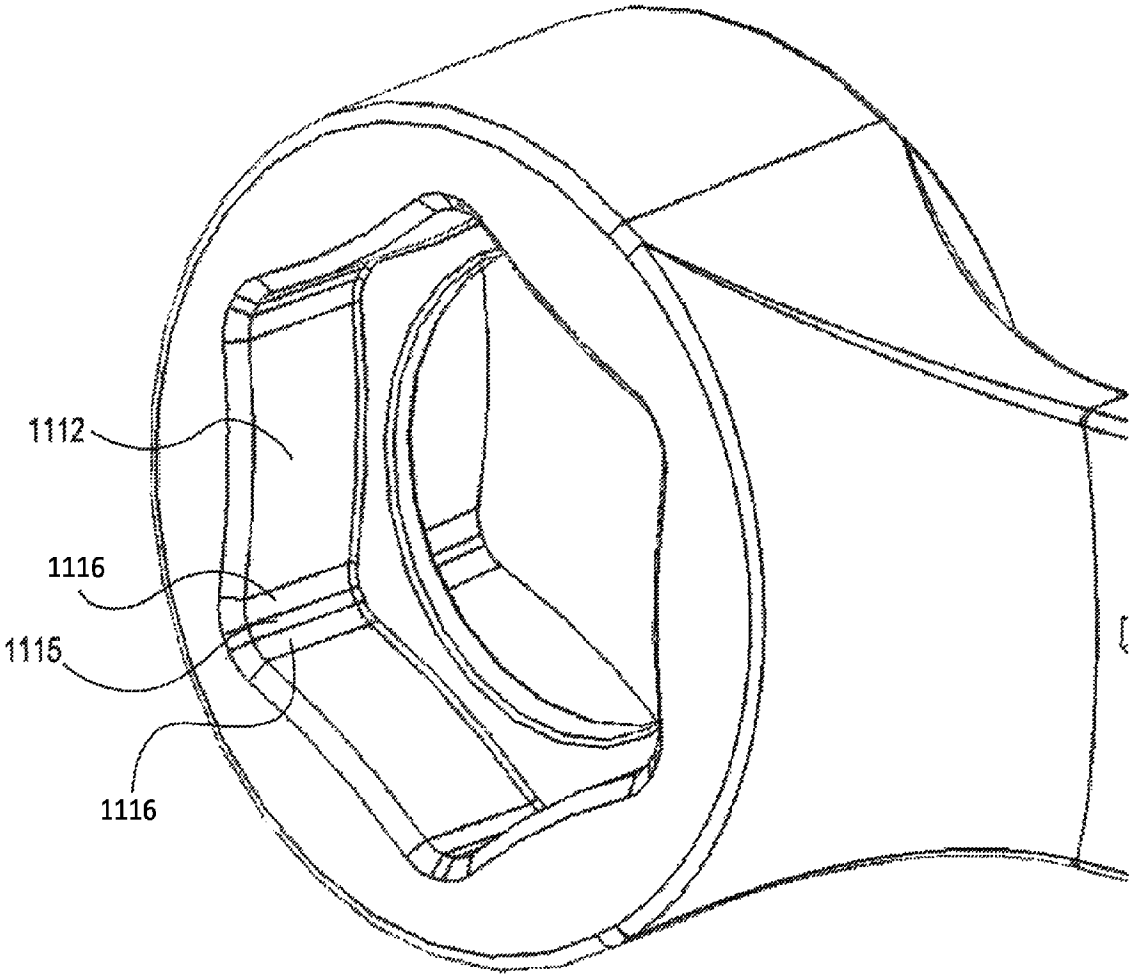
FIG. 14B is a fragmented perspective view of the head of FIG. 12.

The interior faces 1112,1122 of each crown 1110,1120 are configured to engage a bolt received within that crown's bolt receiving space 1119,1129. As can be seen in FIG. 14A, each of the interior faces 1112 is curved inwards towards a horizontal midpoint such that each can be characterized as a lobe. Preferably, the crown 1110 includes six generally identical interior faces 1112 and six generally identical corner sections 1113, although in alternative embodiments the crown 1110 might include a different number of either or both, such as, for example, a crown having twelve interior faces and twelve corner sections. Each corner section 1113 preferably includes two curved faces 1116 joined by a planar face 1115, as illustrated in FIG. 14B.

It will be appreciated that dimensions of each interior face 1112, curved face 1116, and planar face 1115 can be varied. Table 1 of FIG. 22 provides general exemplary dimensions for line segments defining the top and bottom perimeter of each face.

Figure 15:
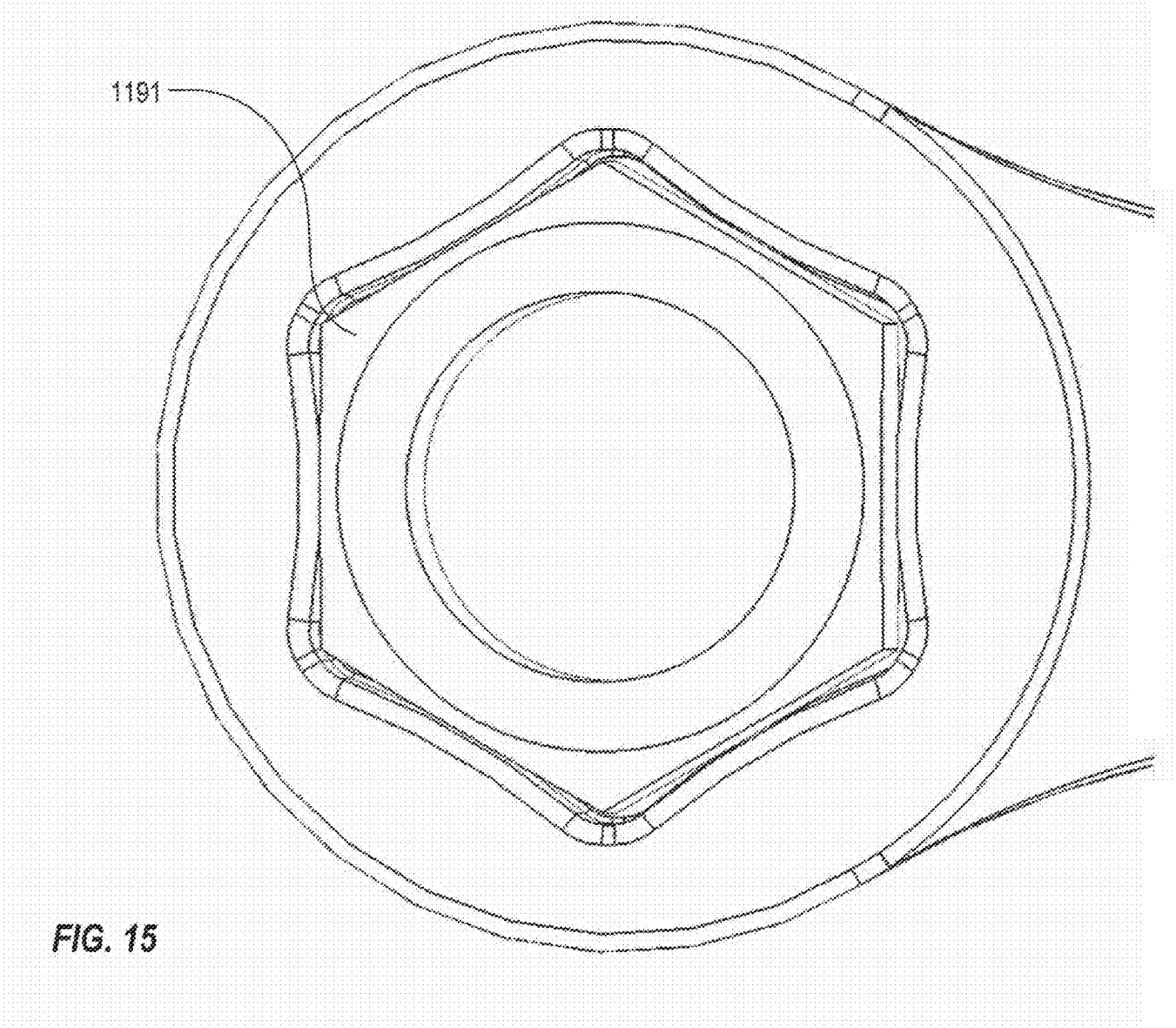
FIGS. 15-16 are fragmented top perspective views of the head of FIG. 12 illustrating the receipt of two different sized bolts in a bolt receiving area.

The interior faces 1112 and corner sections 1113 are sized and dimensioned to correspond to a certain size of bolt, such that when a bolt of that certain size is received within the bolt receiving space 1119 and engaged by the crown 1110, force is applied via hex flats of the bolt rather than via corners of the bolt. FIG. 15 illustrates such a bolt 1191 received within the bolt receiving space 1119. As can be seen in FIG. 15, corners of the bolt 1191 are spaced from the crown 1110, while hex flats of the bolt are generally abutted by lobes of the crown 1110 such that when the head 1104 is rotated by applying force to the shank 1106, force is applied to the bolt 1191 at the hex flats of the bolt 1191 rather than at corners of the bolt 1191. It will be appreciated that this obviates "stripping" of the bolt 1191.

Figure 16:
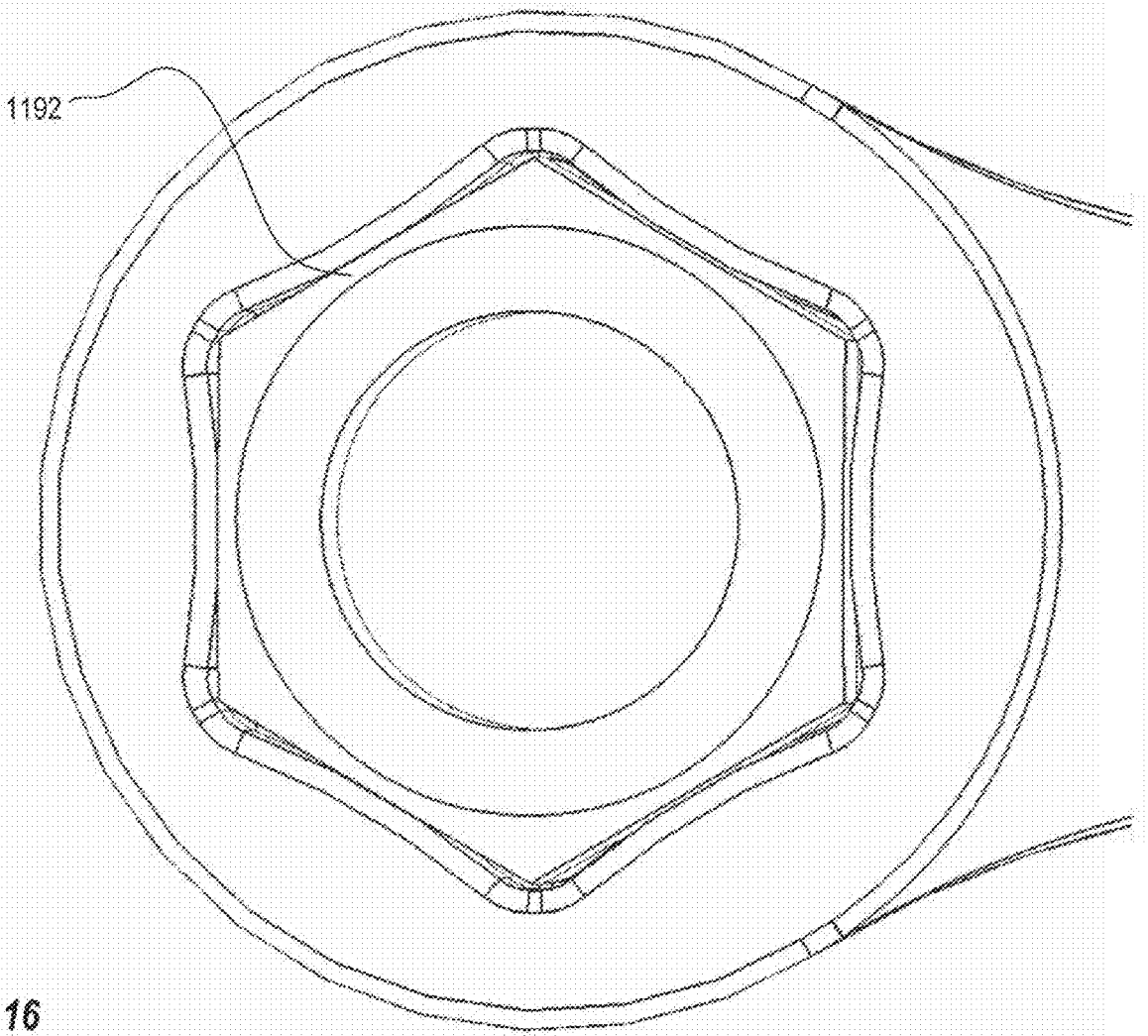

Preferably, the interior faces 1112 are sized and dimensioned to correspond to a second certain size of bolt as well, such that either certain size of bolt can be received within the bolt receiving space 1119 and engaged by the interior faces 1112. FIG. 16 illustrates such a bolt 1192 of a second certain size received within the bolt receiving space 1119. As can be seen in FIG. 16, just like for the bolt 1191, corners of the bolt 1192 are spaced from the crown 1110, while hex flats of the bolt 1192 are generally abutted by lobes of the crown 1110 such that when the head 1104 is rotated by applying force to the shank 1106, force is applied to the bolt 1192 at the hex flats of the bolt 1192 rather than at corners of the bolt.

Preferably, one of the certain sizes is measured in inches and the other of the certain sizes is measured in millimeters.

The interior faces 1122 of crown 1120 are generally similar to the interior faces 1112 of crown 1110, except in that the interior faces 1122 of crown 1120 are sized and dimensioned to correspond to two different certain sizes of bolts. For example, in a preferred implementation, crown 1110 is configured to correspond to seven eighths of an inch (⅞") bolts and twenty two millimeter (22 mm) bolts, while crown 1120 is configured to correspond to thirteen sixteenths of an inch (13⁄16") bolts and twenty one millimeter (21 mm) bolts.

Further, head 1105 is generally similar to head 1104, except in that the interior faces of each crown of head 1105 are sized and dimensioned to correspond to still yet different certain sizes of bolts. In the previously referenced preferred implementation, one of the crowns of head 1105 is configured to correspond to three fourths of an inch (¾") bolts and nineteen millimeter (19 mm) bolts, while the other crown is configured to correspond to eleven sixteenths of an inch (11⁄16") bolts and seventeen millimeter (17 mm) bolts.

In another preferred implementation, one of the crowns of head 1104 is configured to correspond to five eighths of an inch (⅝") bolts and sixteen millimeter (16 mm) bolts, while the other is configured to correspond to nine sixteenths of an inch (9⁄16") bolts and fourteen millimeter (14 mm) bolts, and one of the crowns of head 1105 is configured to correspond to one half of an inch (½") bolts and thirteen millimeter (13 mm) bolts, while the other is configured to correspond to seven sixteenths of an inch (7⁄16") bolts and eleven millimeter (11 mm) bolts.

In still another preferred implementation, one of the crowns of head 1104 is configured to correspond to three eighths of an inch (⅝") bolts and ten millimeter (10 mm) bolts, while the other is configured to correspond to eleven thirty seconds of an inch (11⁄32") bolts and nine millimeter (9 mm) bolts, and one of the crowns of head 1105 is configured to correspond to five sixteenths of an inch (5⁄16") bolts and eight millimeter (8 mm) bolts, while the other is configured to correspond to one fourth of an inch (¼") bolts and six millimeter (6 mm) bolts.

Figure 17:
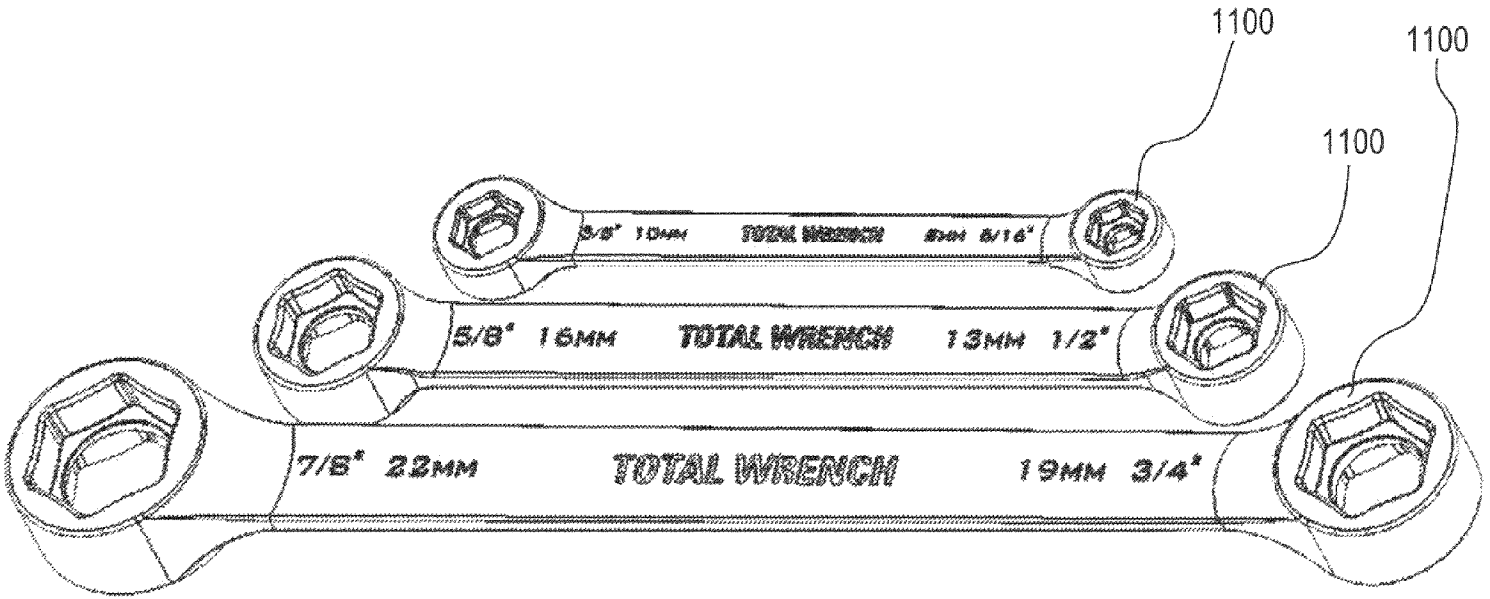
FIG. 17 illustrates wrenches in accordance with preferred implementations.

FIG. 17 illustrates wrenches 1100 in accordance with each of these three preferred implementations.

Quad Wrench

Figure 18:
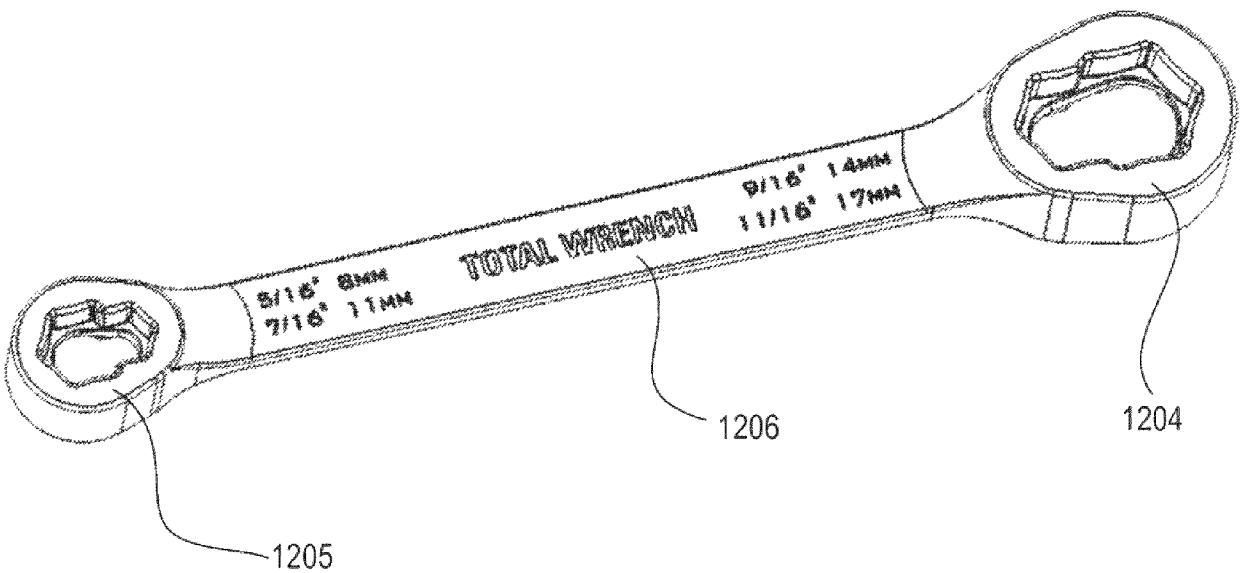
FIG. 18 illustrates a quad wrench in accordance with one or more preferred embodiments of the present invention.
Figure 19:
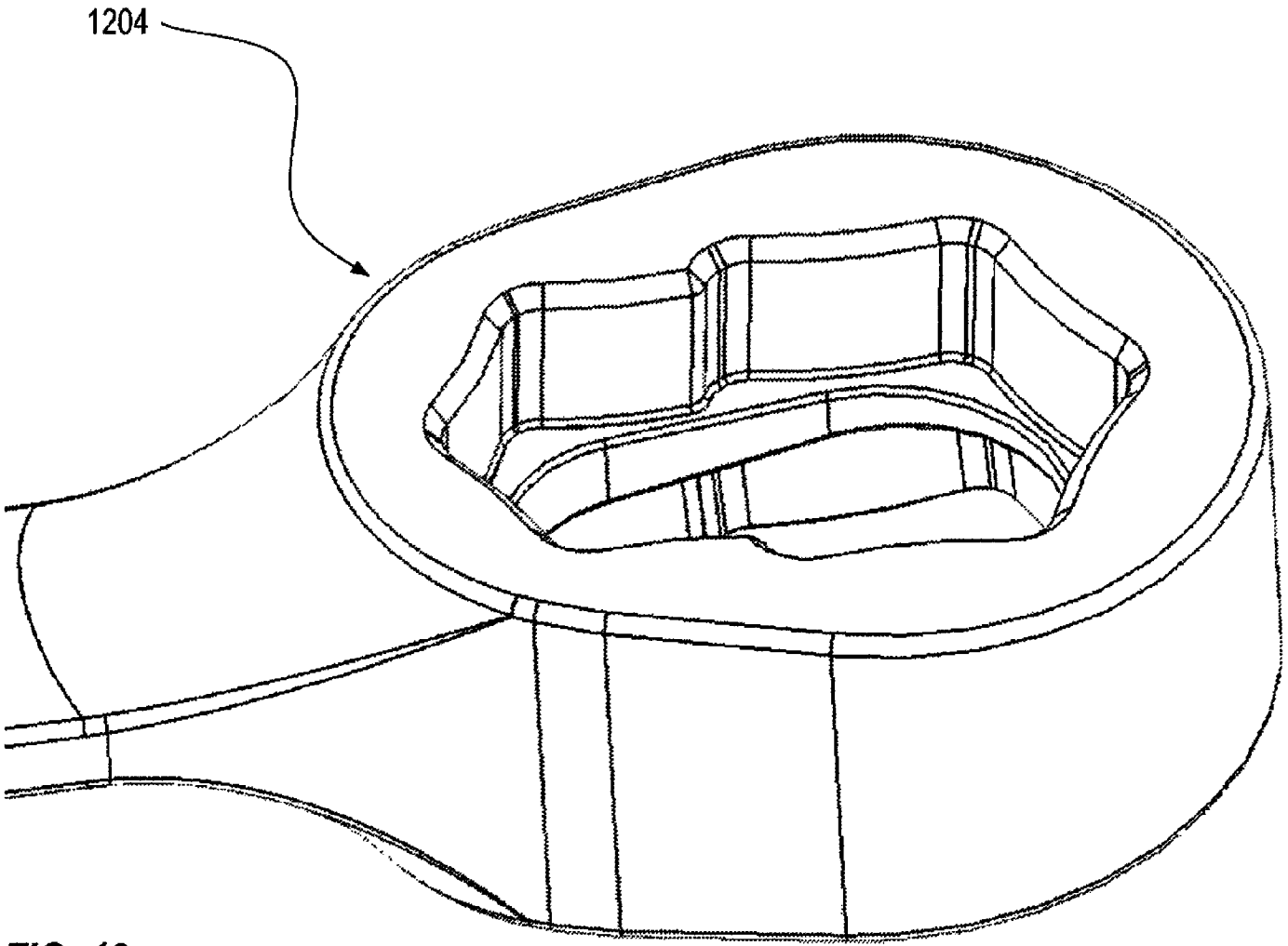
FIG. 19 is a fragmented close-up view of one of the heads of the quad wrench of FIG. 18.

FIG. 18 illustrates a quad wrench 1200 in accordance with one or more preferred embodiments of the present invention. Wrench 1200 comprises two heads 1204,1205 connected by a shank 1206. FIG. 19 is a close-up view of one of the heads 1204.

Figure 20A:
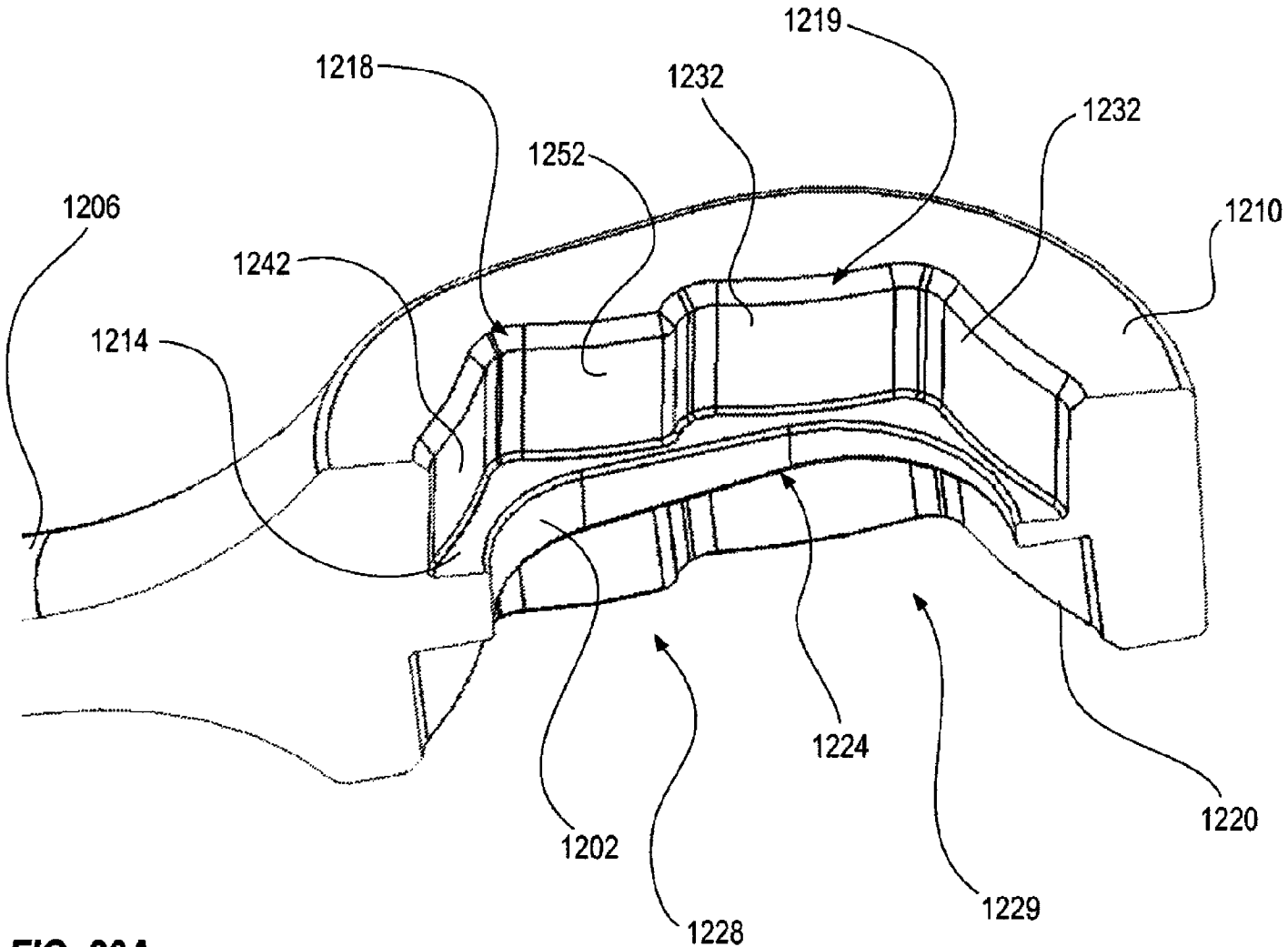
FIG. 20A is a fragmented cross-sectional view of the head of FIG. 19.

As can be seen in FIG. 20A, which is a cross-sectional view of the head 1204 of FIG. 19, each head 1204 includes paired, opposing crowns 1210,1220 generally separated by a tapered internal guide 1202. As its name implies, and as can be seen in FIG. 20A, the tapered internal guide 1202 is tapered in that it is thicker proximate the shank 1206 and tapers off as it moves away therefrom, as is perhaps best seen by comparison of FIG. 20A with FIGS. 20C-D, which figures are cross-sectional views of FIG. 20B.

It will be appreciated, however, that, just at noted with respect to dual wrench 1100, the internal guide of a quad wrench does not have to be tapered. In a preferred embodiment of the present invention, a non-tapered internal guide of a generally constant thickness is utilized. It will be appreciated then that, although the description herein focuses largely on wrenches having a tapered internal guide, such as tapered internal guide 1202, aspects and features disclosed herein, to the extent practicable, are equally contemplated for use with wrenches having a non-tapered internal guide.

It will be appreciated from the description thus far that head 1204 is similar to head 1104 in many respects. Like each crown 1110,1120 of head 1104, each crown 1210,1220 of head 1204 includes a plurality of interior faces. However, whereas a single bolt receiving space 1119,1129 is defined by the plurality of interior faces 1112,1122 of each crown 1110, 1120 and the planar surfaces 1114,1124 of tapered internal guide 1102, two bolt receiving spaces 1218,1228,1219,1229 are defined by the interior faces of each crown 1210,1220 and the planar surfaces 1214,1224 of tapered internal guide 1202 (and preferably corner sections as described hereinbelow).

Figure 20B:
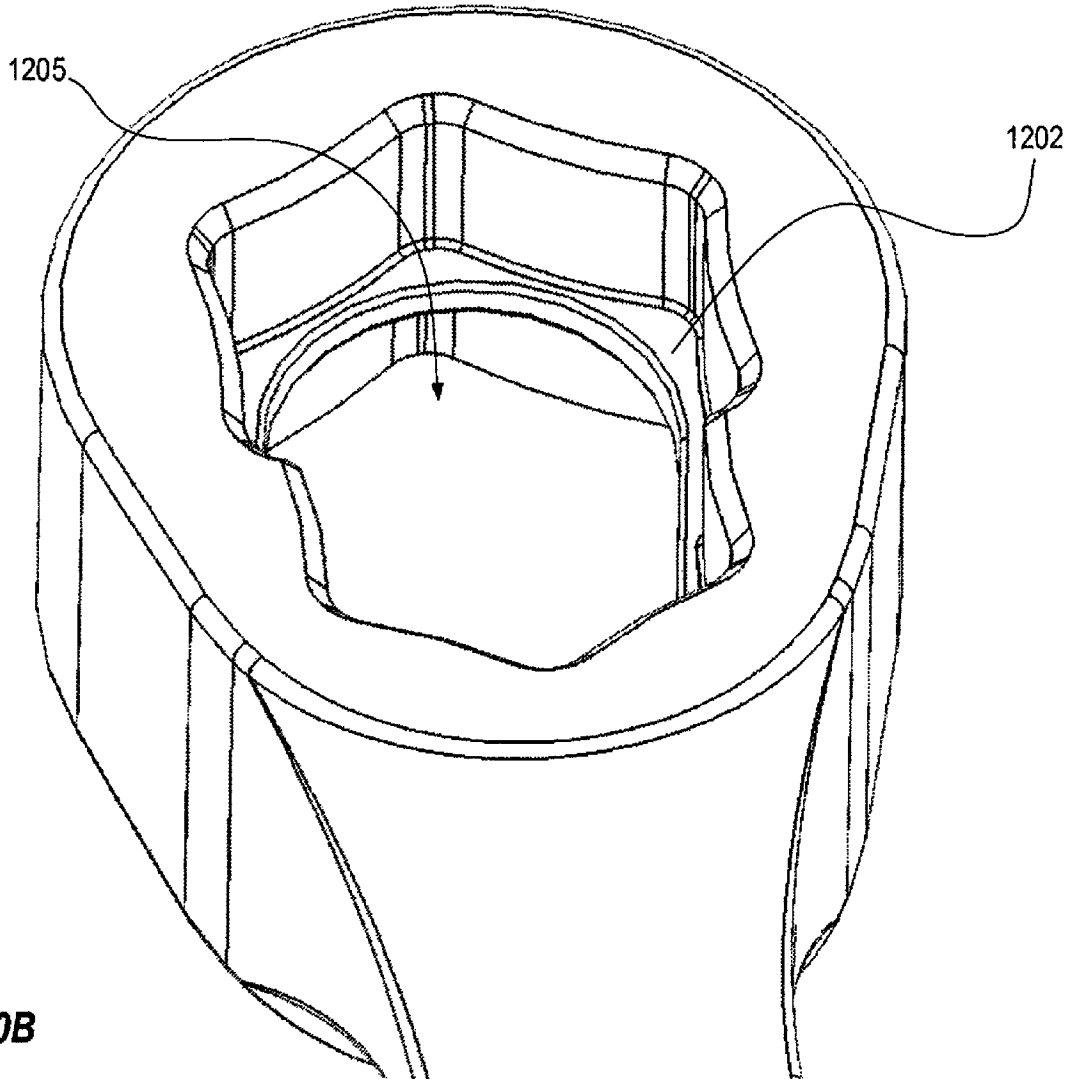
FIG. 20B is a fragmented perspective view of the head of FIG. 19.
Figure 20C:
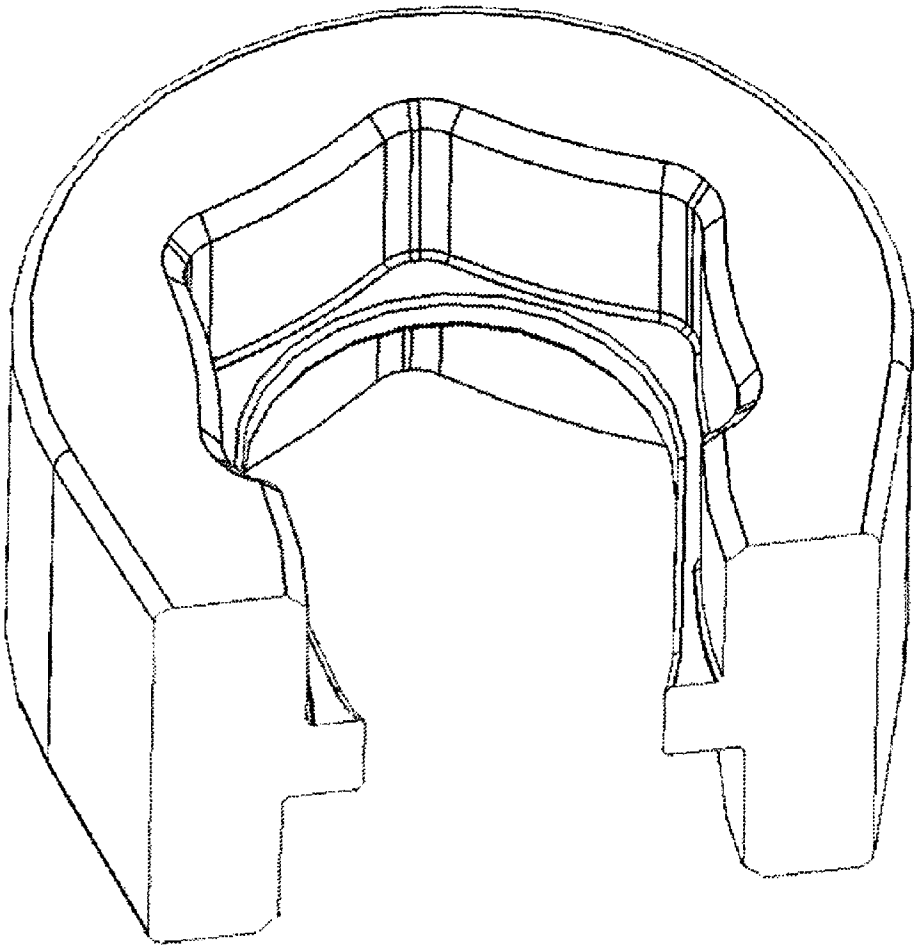
FIGS. 20C-D are cross-sectional views of FIG. 20B.
Figure 20D:
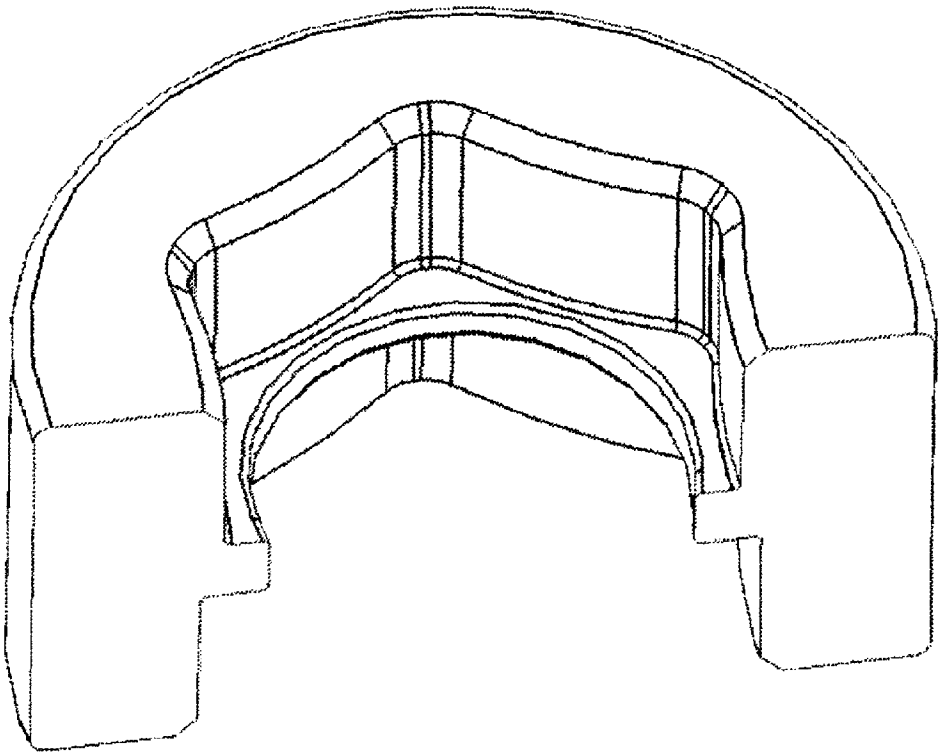
Figure 20E:
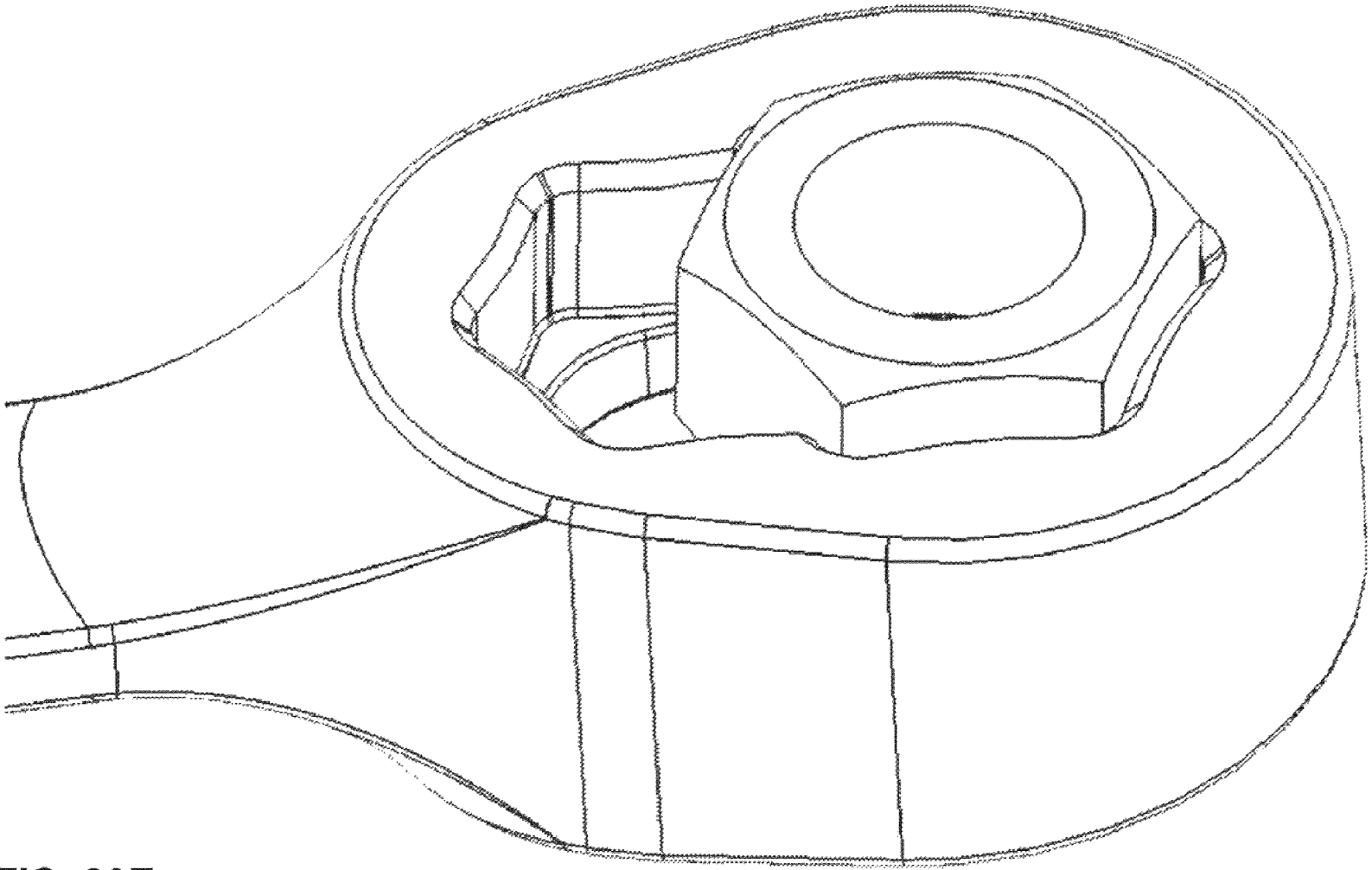
FIGS. 20E-M are fragmented cross-sectional views of the head of FIG. 19 illustrating the receipt of bolts in bolt receiving areas.
Figure 20F:
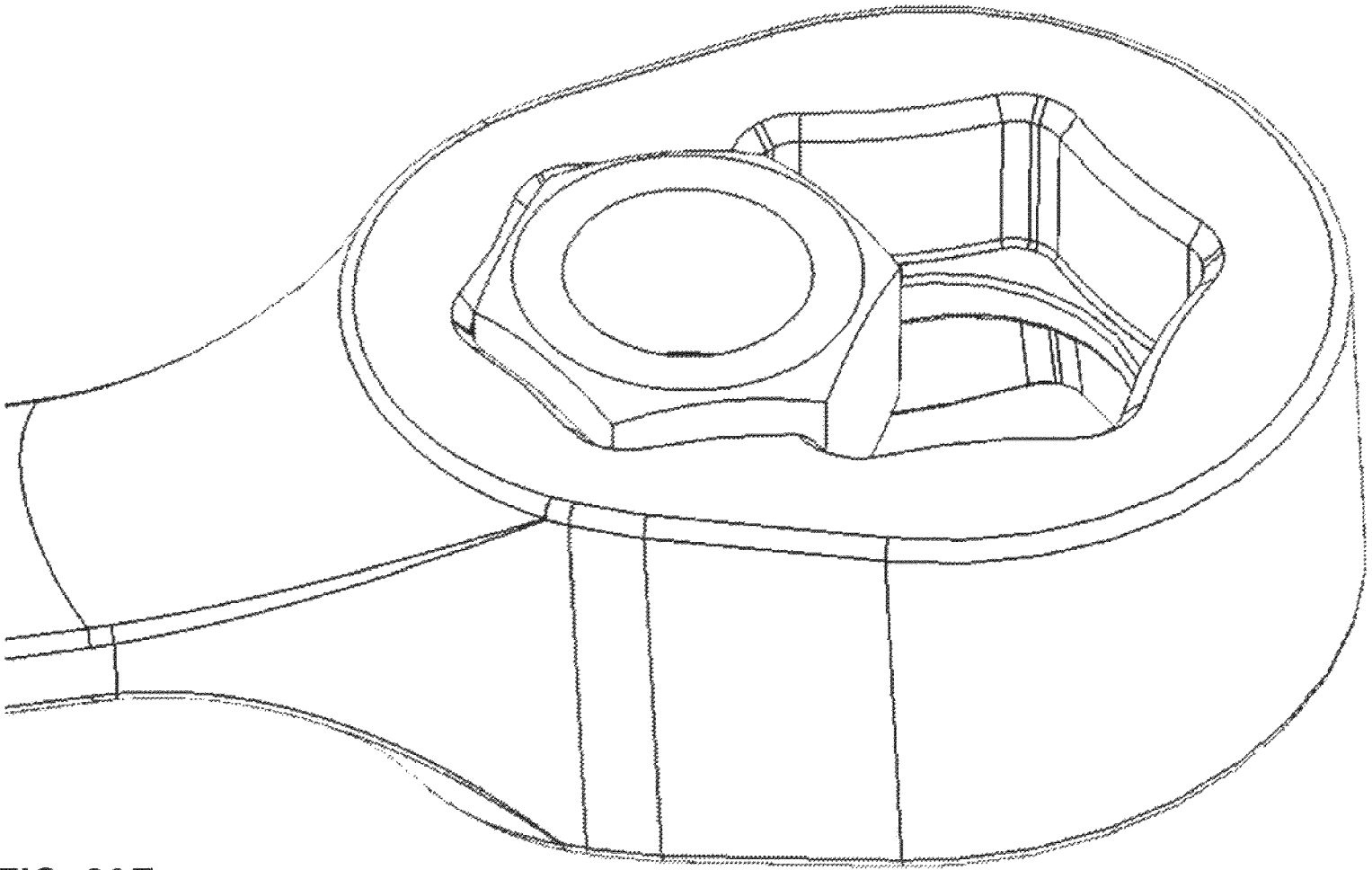
Figure 20G:
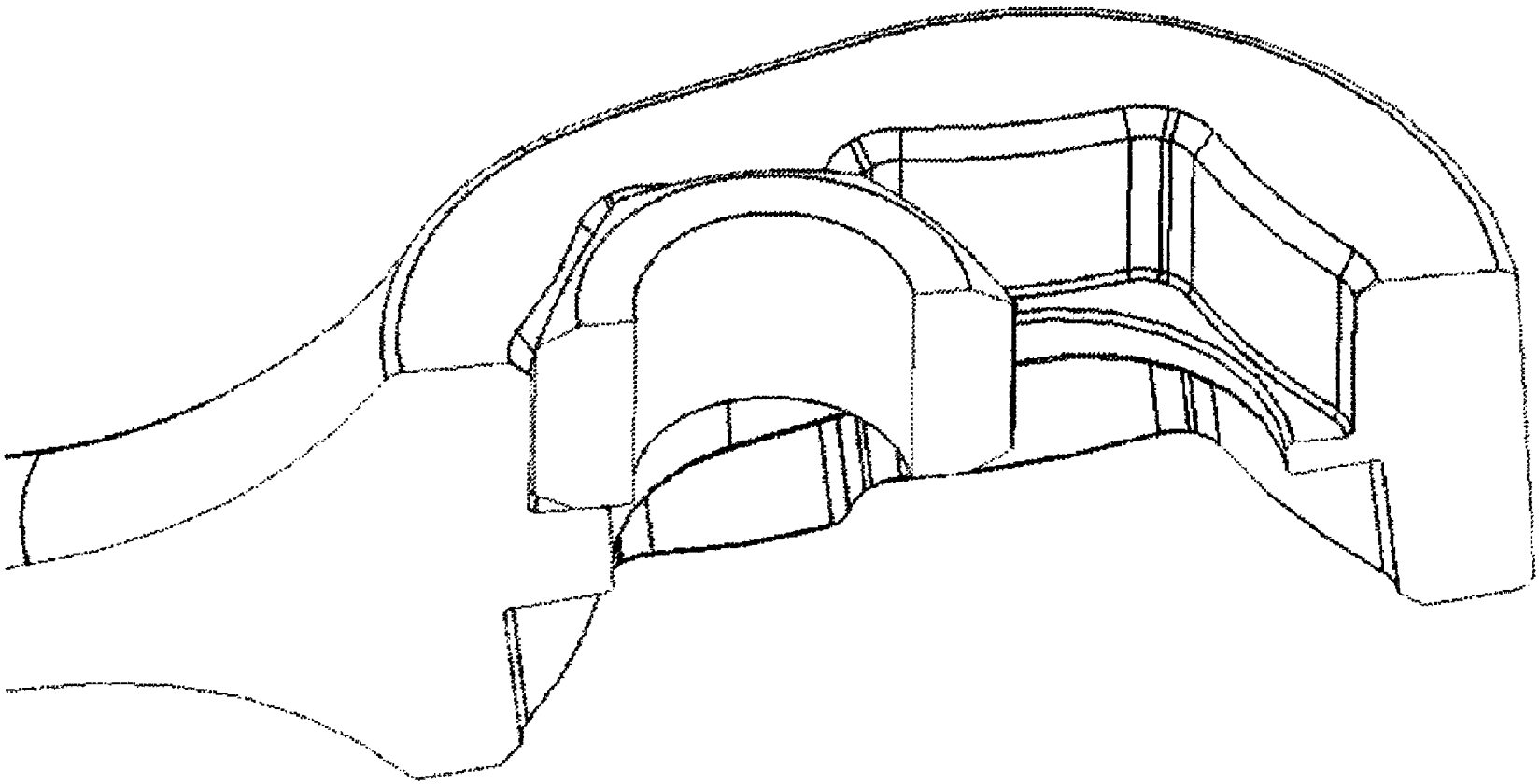
Figure 20H:
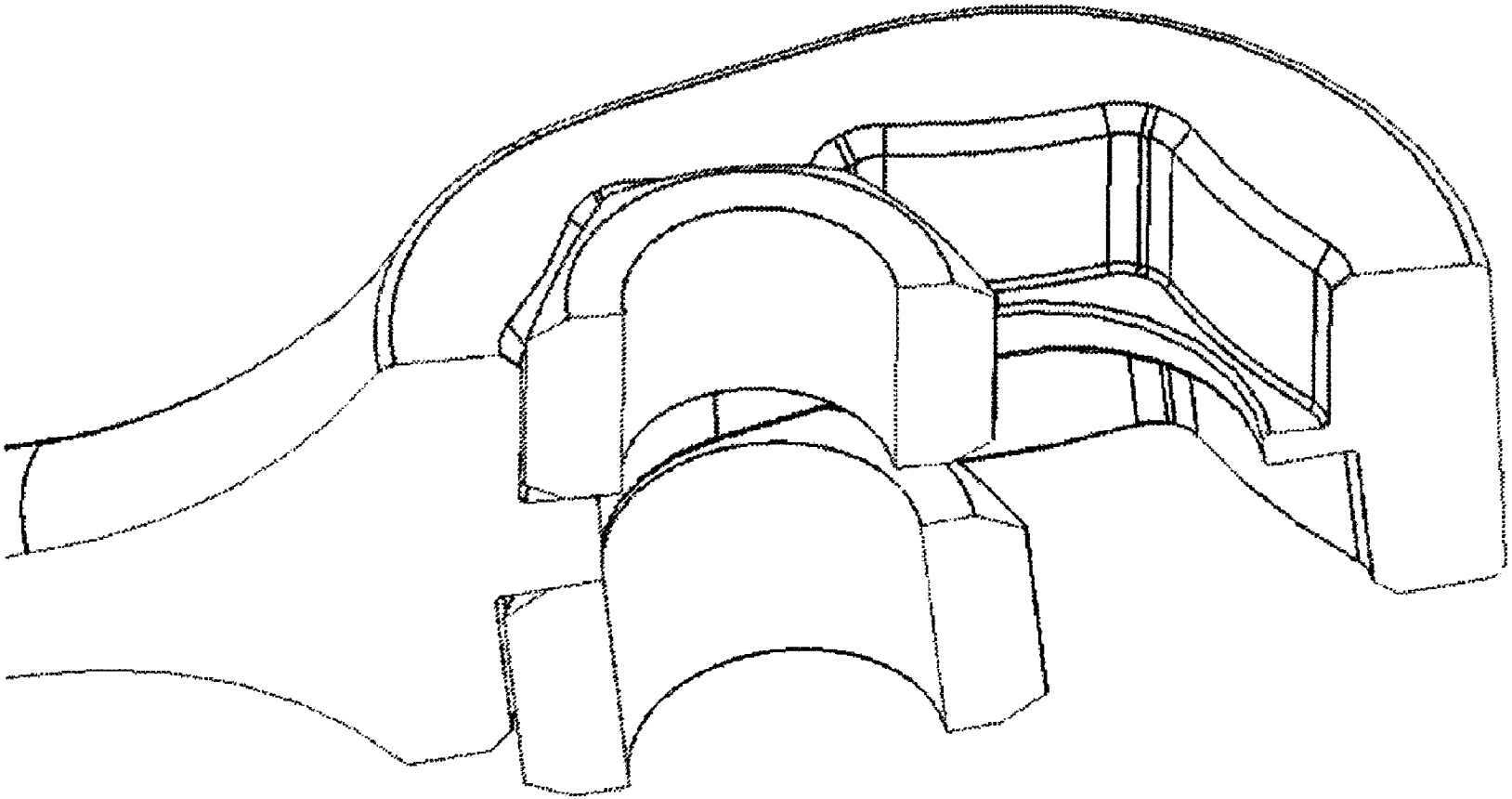
Figure 20I:
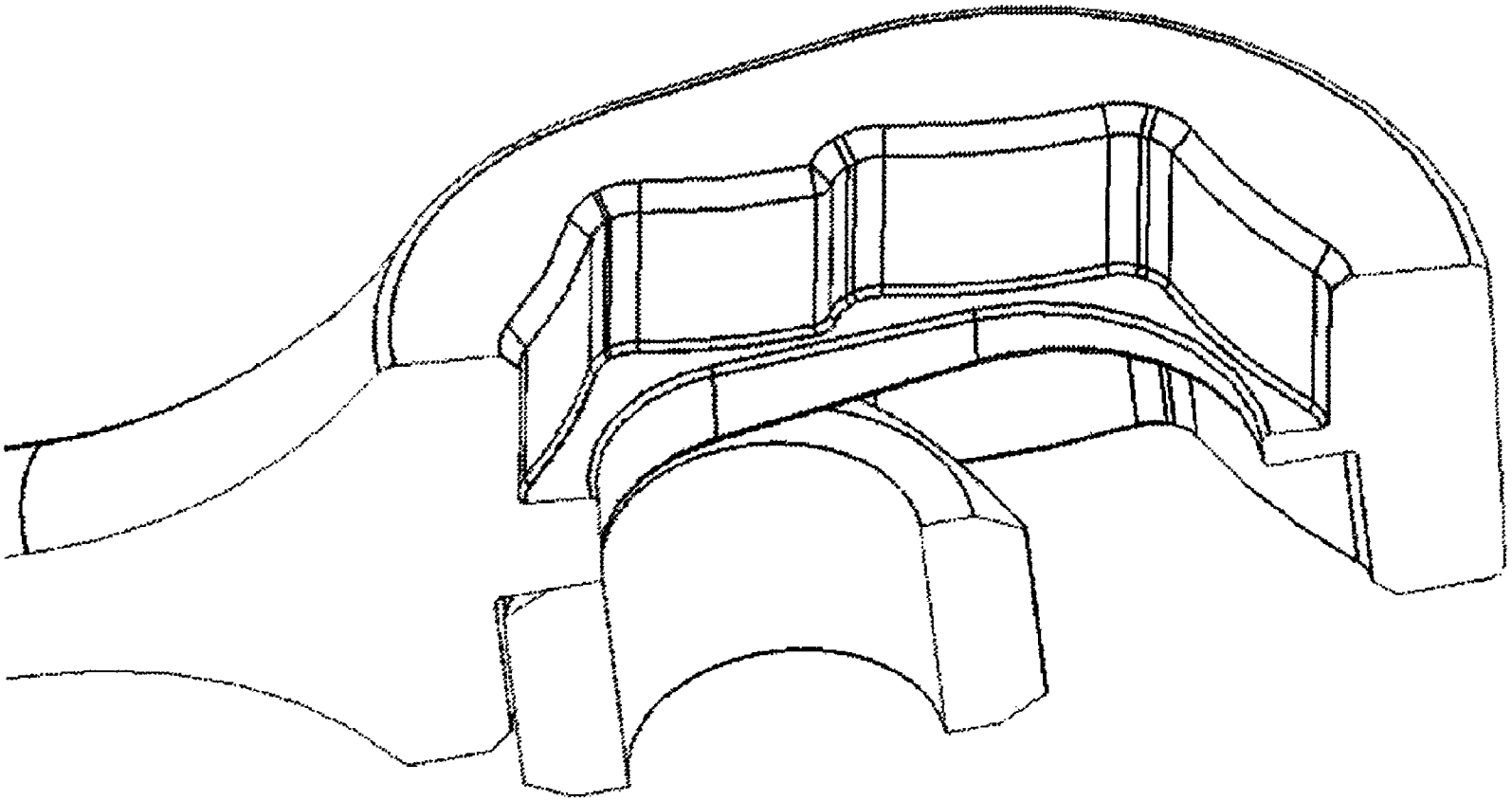
Figure 20J:
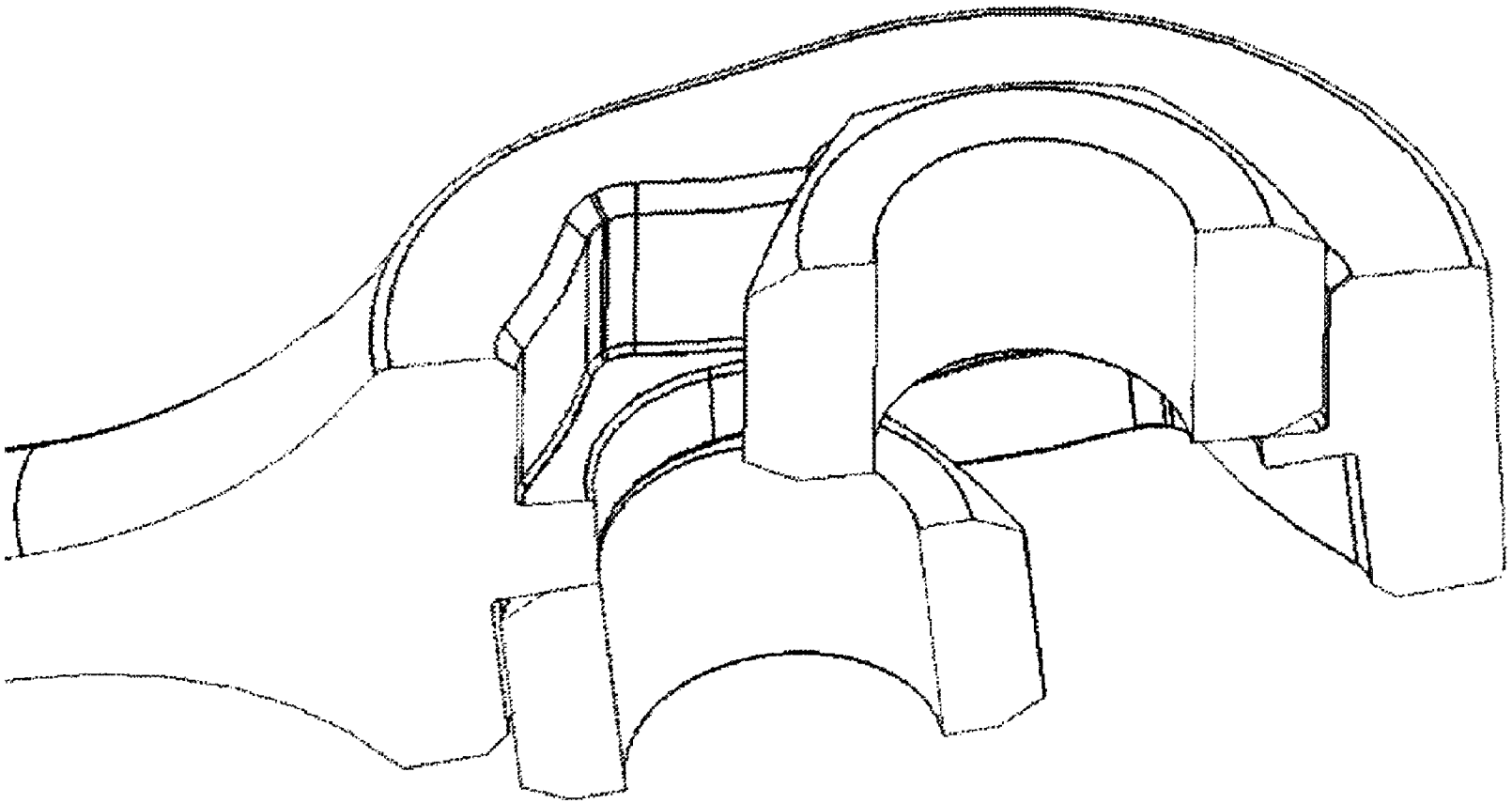
Figure 20K:
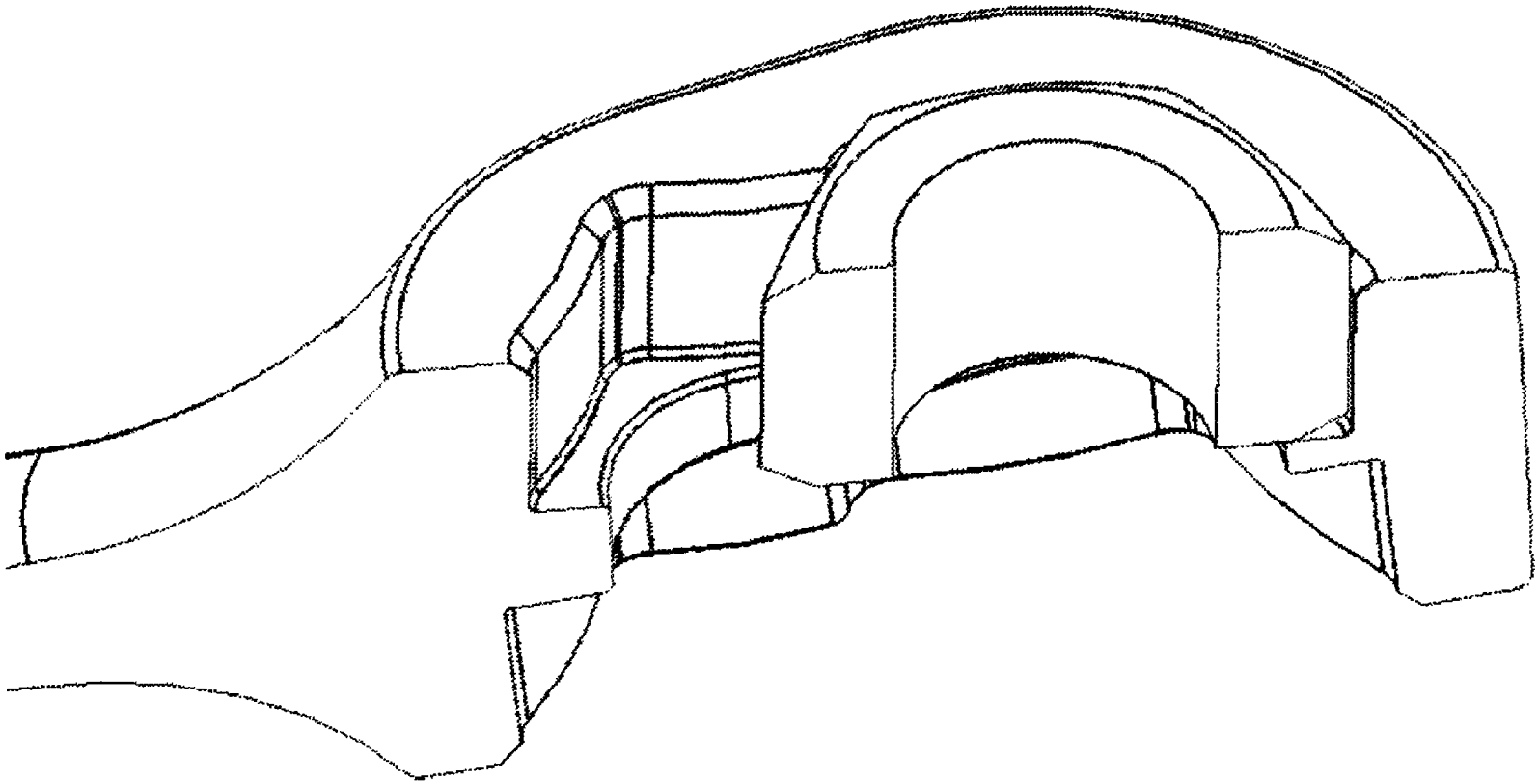
Figure 20L:
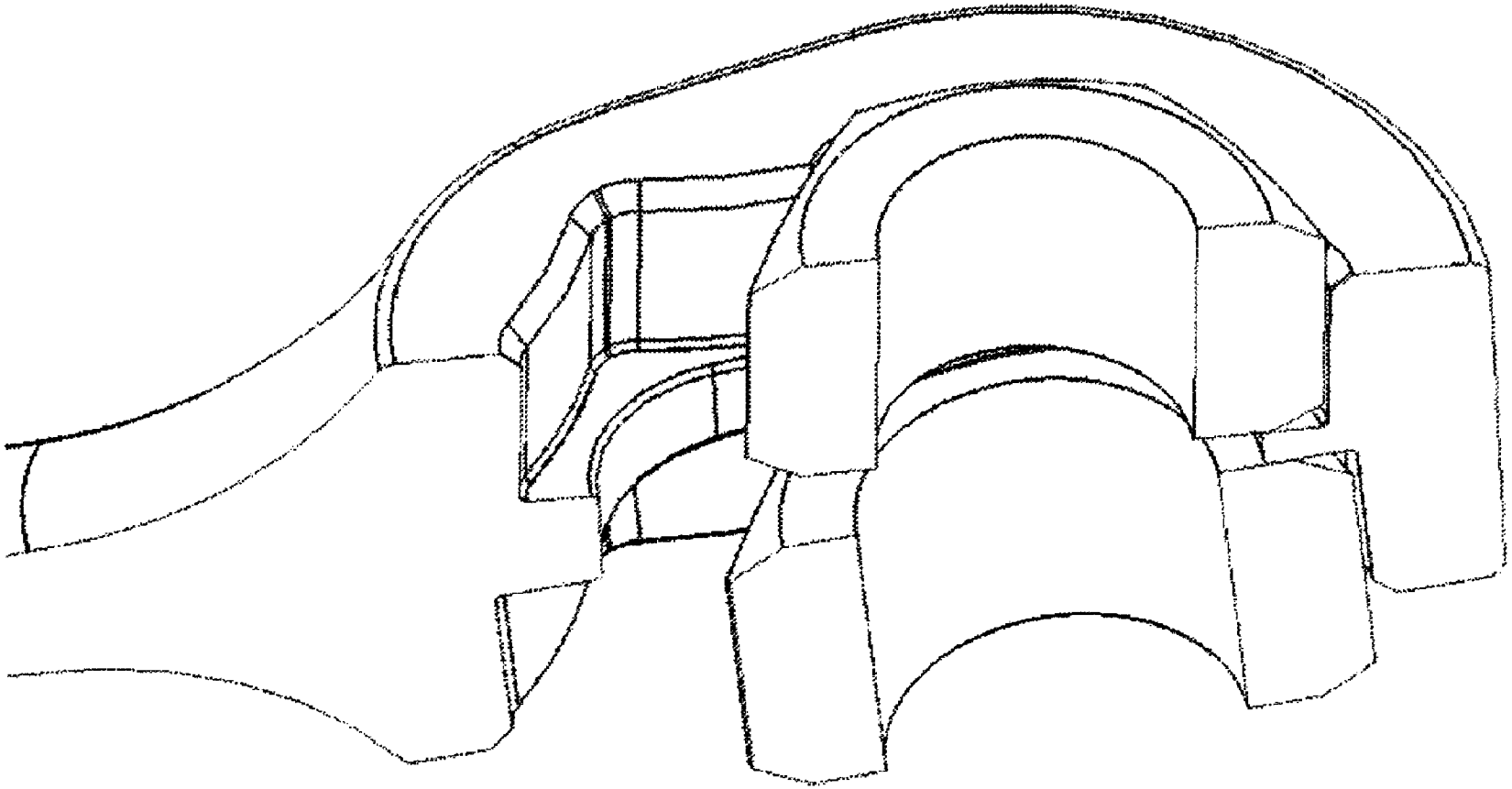
Figure 20M:
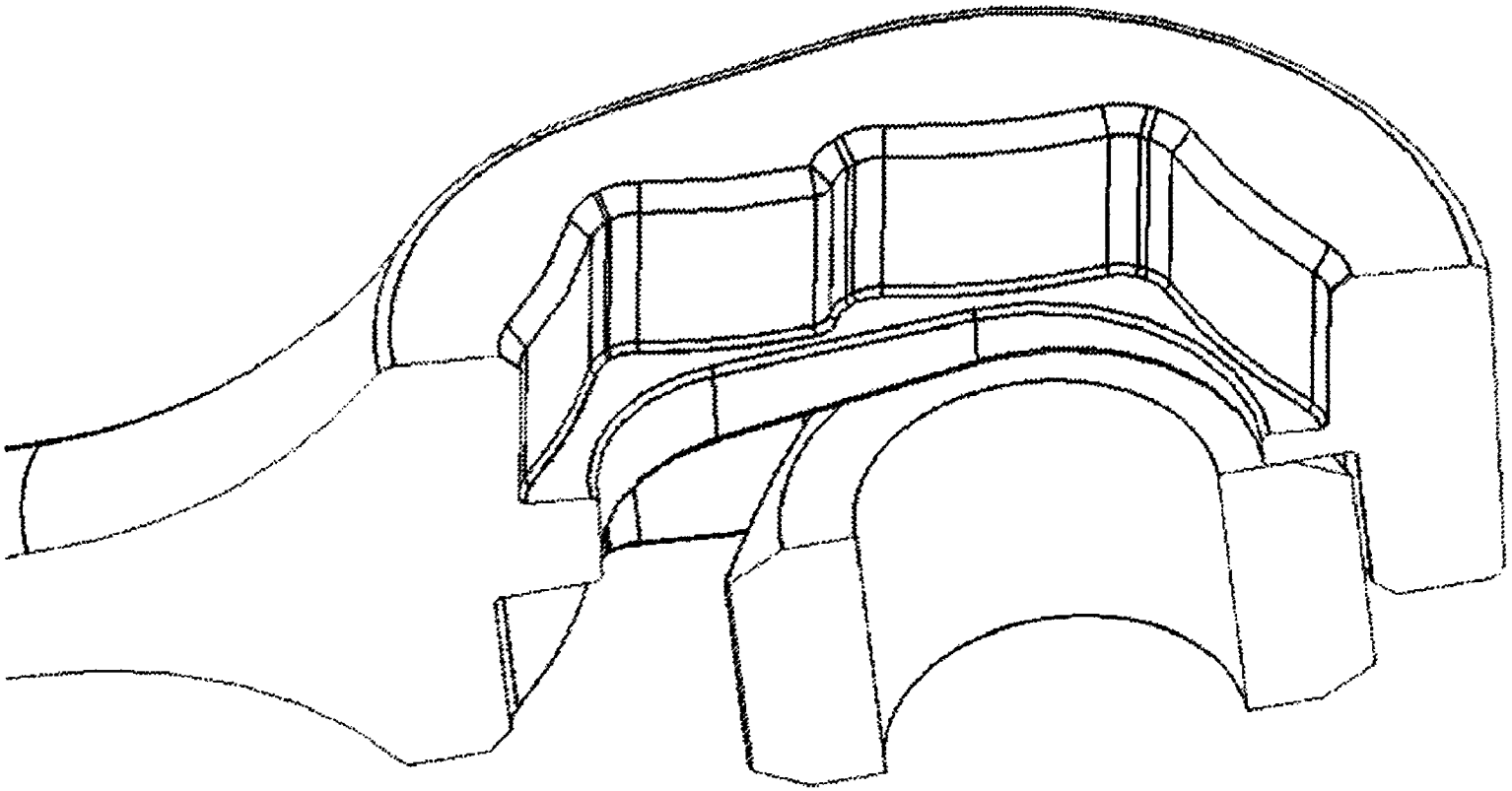

It will be appreciated that when a bolt is received within the bolt receiving space 1218,1228,1219,1229 of one of the crowns 1210,1220, tapered internal guide 1202 will prevent the bolt from passing through to a bolt receiving space of the other crown as illustrated in FIGS. 20E-M. The tapered internal guide 1102 can thus be characterized as a lip, or ledge, upon which a bolt can rest. The tapered internal guide 1102 has an aperture 1105 defined therethrough, as can be seen in FIG. 20B. The aperture 1105 is defined therethrough in a direction generally orthogonal to the direction of tapering.

Figure 21A:
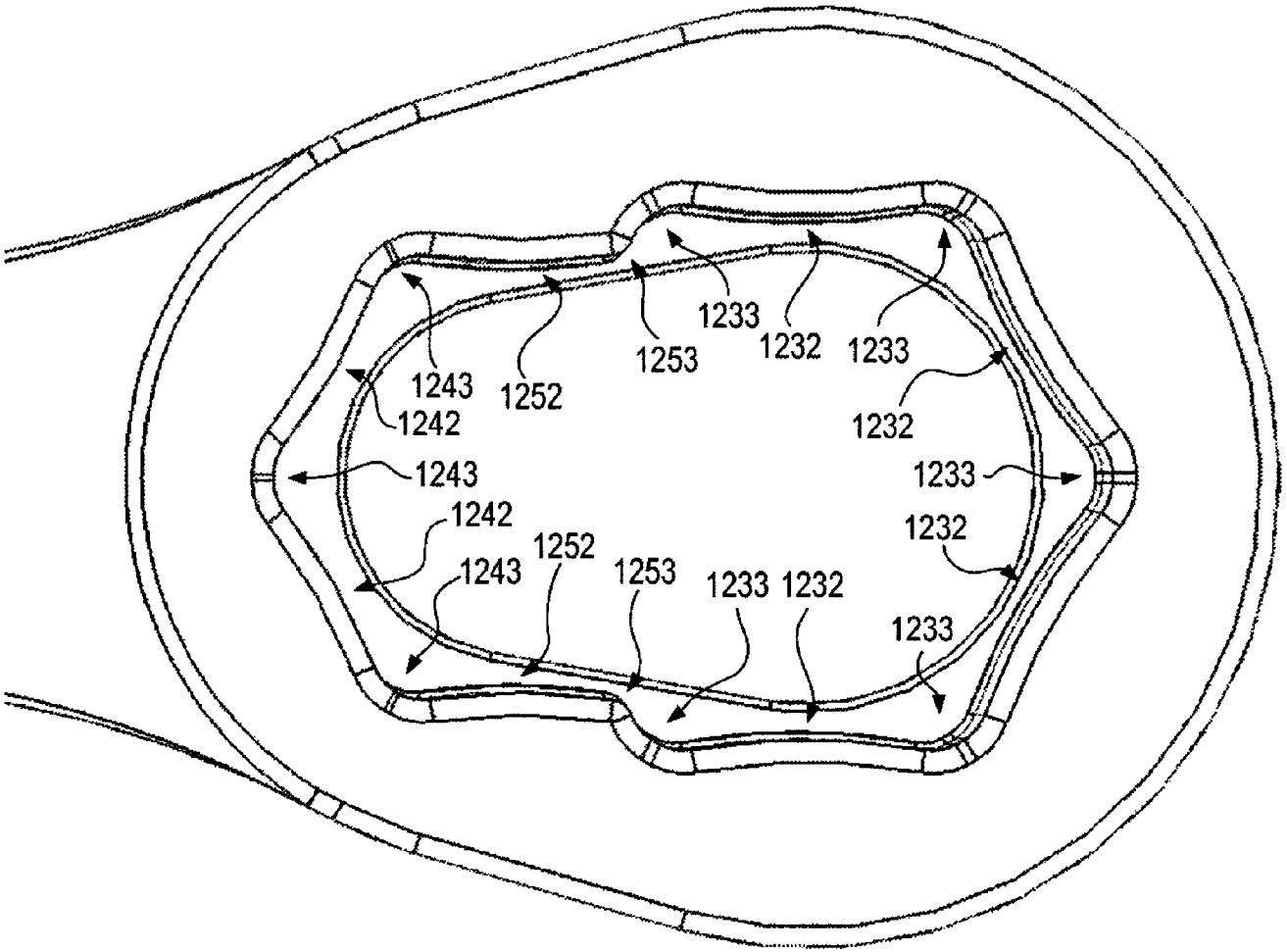
FIG. 21A is a fragmented top perspective view of the head of FIG. 12.

The interior faces of crown 1210 are configured to engage a bolt received within either bolt receiving space 1218,1219. Preferably, as illustrated in FIG. 21A, the crown 1210 includes four interior faces 1232, two interior faces 1242, and two interior faces 1252. As can be seen in FIG. 21A, each of the interior faces is curved inwards towards a horizontal midpoint such that each can be characterized as a lobe.

Figure 21B:
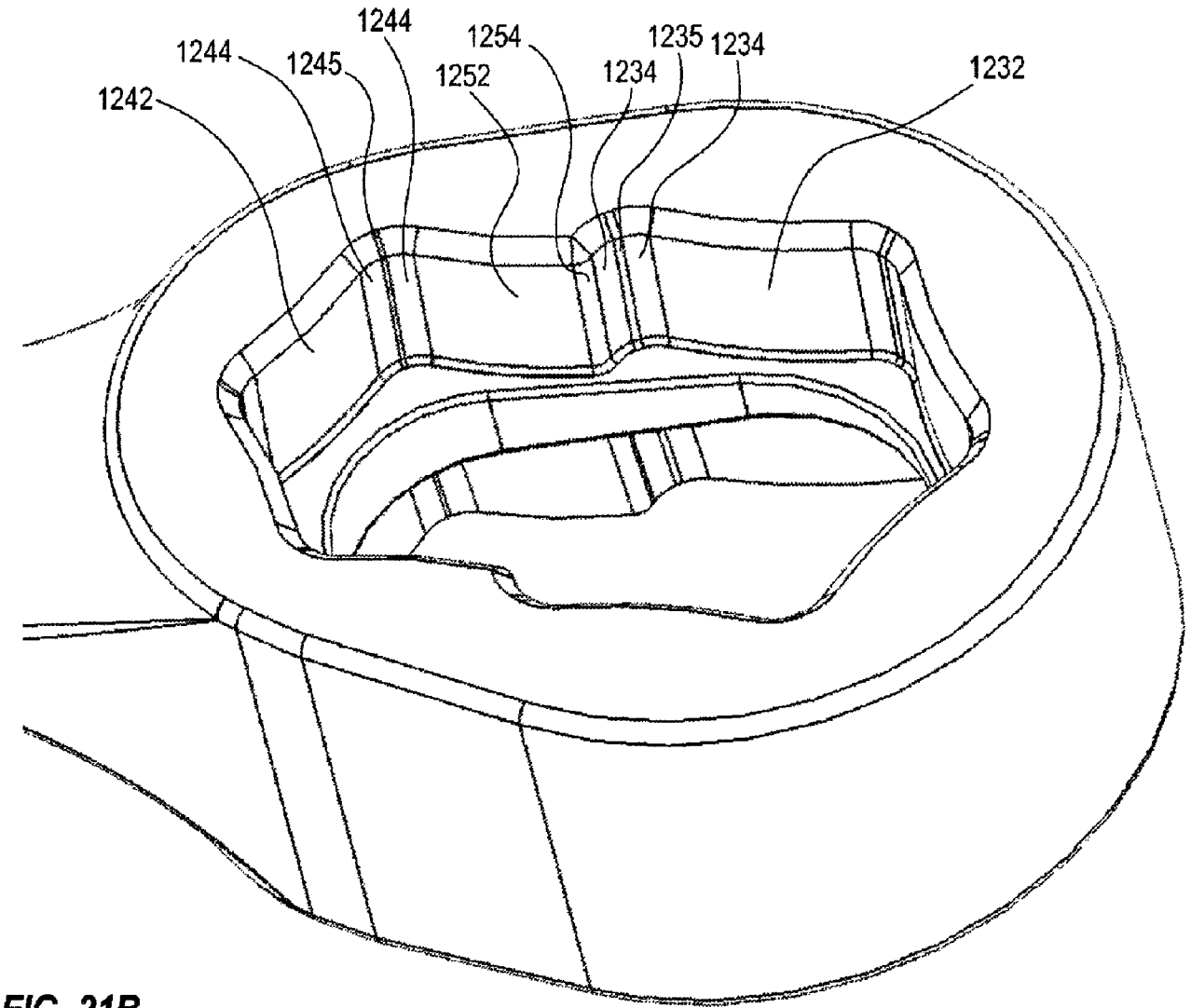
FIGS. 21B-C are fragmented perspective views of the head of FIG. 12.
Figure 21C:
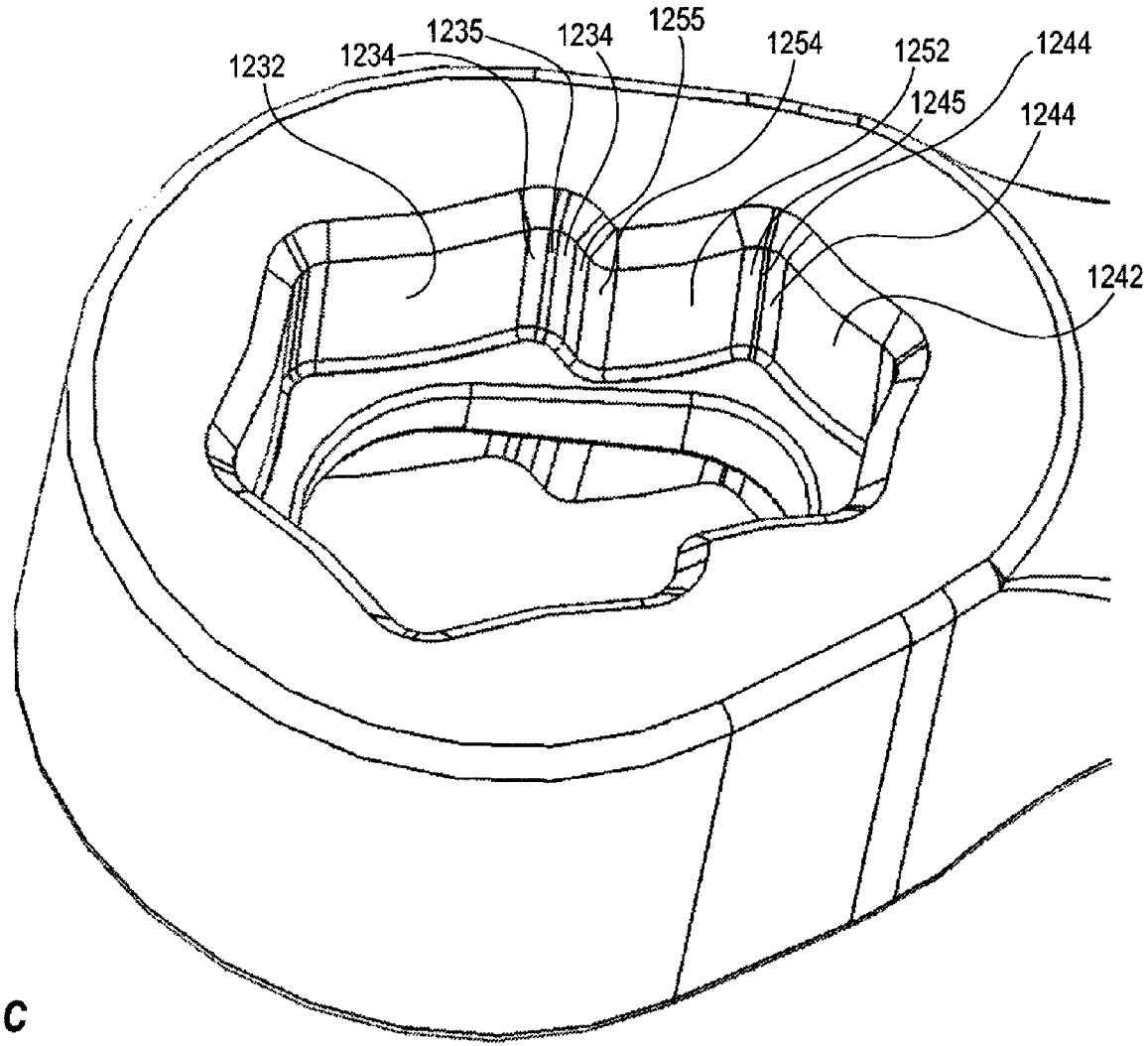

The crown 1210 further includes five corner sections 1233, three corner sections 1243, and two corner sections 1253. Each corner section 1233 preferably includes two curved faces 1234 joined by a planar face 1235, as illustrated in FIG. 21B. Similarly, each corner section 1243 preferably includes two curved faces 1244 joined by a planar face 1245. Each corner section 1253 preferably includes either a curved face 1254, as illustrated in FIG. 21B, or a curved face 1254 and a planar face 1255, as illustrated in FIG. 21C.

It will be appreciated that dimensions of each interior face 1232,1242,1252, curved face 1234,1244,1254, and planar face 1235,1245,1255 can be varied. Table 2 of FIG. 23 provides general exemplary dimensions for line segments defining the top and bottom perimeter of each face.

The interior faces 1232,1242,1252, curved faces 1234,1244,1254, and planar faces 1235,1245 defining each bolt receiving space 1218,1219 are sized and dimensioned such that each bolt receiving space 1218,1219 corresponds to a certain size of bolt. Notably, bolt receiving space 1218 and bolt receiving space 1219 correspond to different size bolts. Preferably, just as with wrench 1100, when a bolt of a certain size is received within proper corresponding bolt receiving space 1218,1219, corners of the bolt are spaced from the crown 1210, while hex flats of the bolt are generally abutted by lobes of the crown 1210 such that when the head 1204 is rotated by applying force to the shank 1206, force is applied to the bolt at the hex flats of the bolt rather than at corners of the bolt. Just as with wrench 1100, it will be appreciated that this obviates "stripping" of the bolt 1191.

Preferably, interior faces 1232,1242,1252, curved faces 1234,1244,1254, and planar faces 1235,1245 defining each bolt receiving space 1218,1219 are sized and dimensioned such that each bolt receiving space 1218,1219 corresponds to a second certain size of bolt as well, and thus either certain size of bolt can be received within the bolt receiving space 1218,1219 and engaged by the interior faces 1232,1242,1252. Just like for the first certain sized bolt, preferably, when a bolt of the second certain size is received within proper corresponding bolt receiving space 1218,1219, corners of the bolt are spaced from the crown 1210, while hex flats of the bolt are generally abutted by lobes of the crown 1210 such that when the head 1204 is rotated by applying force to the shank 1206, force is applied to the bolt at the hex flats of the bolt rather than at corners of the bolt.

Preferably, one of the certain sizes is measured in inches and the other of the certain sizes is measured in millimeters.

Crown 1220 is generally similar to crown 1210, except in that each of the bolt receiving spaces 1228,1229 of crown 1220 correspond to two still yet different certain sizes of bolts. Thus, each bolt receiving space 1218,1219,1228,1229 corresponds to two different certain sizes of bolts, for a total of eight different corresponding bolt sizes.

For example, in a preferred implementation, bolt receiving space 1218 of crown 1210 is configured to correspond to nine sixteenths of an inch (9/16") bolts and fourteen millimeter (14 mm) bolts, bolt receiving space 1219 of crown 1210 is configured to correspond to eleven sixteenths of an inch (11/16") bolts and seventeen millimeter (17 mm) bolts, bolt receiving space 1228 of crown 1220 is configured to correspond to five eighths of an inch (5/8") bolts and sixteen millimeter (16 mm) bolts, and bolt receiving space 1229 of crown 1220 is configured to correspond to three fourths of an inch (3/4") bolts and nineteen millimeter (19 mm) bolts.

Further, head 1205 is generally similar to head 1204, except in that each bolt receiving space of head 1105 is sized and dimensioned to correspond to still yet different certain sizes of bolts. In the previously referenced preferred implementation, a first bolt receiving area of a first one of the crowns is configured to correspond to five sixteenths of an inch (5/16") bolts and eight millimeter (8 mm) bolts, the other bolt receiving area of the first one of the crowns is configured to correspond to seven sixteenths of an inch (7/16") bolts and eleven millimeter (11 mm) bolts, a first bolt receiving area of the other crown is configured to correspond to three eighths of an inch (5/8") bolts and ten millimeter (10 mm) bolts, and the other bolt receiving area of the other crown is configured to correspond to one half of an inch (1/2") bolts and thirteen millimeter (13 mm) bolts.

Based on the foregoing description, it will be readily understood by those persons skilled in the art that the present invention is susceptible of broad utility and application. Many embodiments and adaptations of the present invention other than those specifically described herein, as well as many variations, modifications, and equivalent arrangements, will be apparent from or reasonably suggested by the present invention and the foregoing descriptions thereof, without departing from the substance or scope of the present invention. Accordingly, while the present invention has been described herein in detail in relation to one or more preferred embodiments, it is to be understood that this disclosure is only illustrative and exemplary of the present invention and is made merely for the purpose of providing a full and enabling disclosure of the invention. The foregoing disclosure is not intended to be construed to limit the present invention or otherwise exclude any such other embodiments, adaptations, variations, modifications or equivalent arrangements, the present invention being limited only by the claims appended hereto and the equivalents thereof.

It will be appreciated by those skilled in the art that the preceding examples and preferred embodiments are exemplary and not limiting to the scope of the present invention. It is intended that all permutations, enhancements, equivalents, and improvements thereto that are apparent to those skilled in the art upon a reading of the specification and a study of the drawings are included within the true spirit and scope of the present invention.

What is claimed is:

1. A quad wrench comprising:

(a) a head comprising
- (i) an internal guide,
- (ii) first and second crowns separated by said internal guide, each of said first and second crowns comprising
  - (A) a plurality of interior faces consisting of a first group of four interior faces generally identical to one another, a second group of two interior faces generally identical to one another but generally not identical to the interior faces of the first group, and a third group of two interior faces that are generally identical to one another but generally not identical to the interior faces of the first or second groups,
  - (B) first and second bolt receiving spaces, each bolt receiving space being at least partially defined by an outer surface of said internal guide and some of said plurality of interior faces, and
  - (C) ten corner sections joining said interior faces, said ten corner sections consisting of:
    - (I) a first group of five corner sections generally identical to one another, wherein each corner section of said first group of corner sections comprises two curved faces joined by a planar face,
    - (II) a second group of three corner sections generally identical to one another but generally not identical to the corner sections of the first group, wherein each corner section of said second group of corner sections comprises two curved faces joined by a planar face
    - (III) a third group of two corner sections generally identical to one another but generally not identical to the corner sections of the first or second groups, wherein each corner section of said third group of corner sections comprises a curved face and a planar face; and (b) a shank connected to said head;

(c) wherein
- (i) each bolt receiving space of each crown is configured to correspond to both a first certain size of bolt and a second certain size of bolt such that a bolt of either certain size received in the bolt receiving space can be rotated when force is applied to the shank, and
- (ii) each bolt receiving space of the quad wrench is configured to correspond to two different certain sizes of bolts.

2. The quad wrench of claim 1, further comprising a second head, the second head comprising (a) an internal guide; and (b) first and second crowns separated by said internal guide, each of said first and second crowns comprising
- (i) a plurality of interior faces, and
- (ii) first and second bolt receiving spaces, each bolt receiving space being at least partially defined by an outer surface of said internal guide and some of said plurality of interior faces;

(c) wherein
- (i) each bolt receiving space of each crown of the second head is configured to correspond to both a first certain size of bolt and a second certain size of bolt such that a bolt of either certain size received in the bolt receiving space can be rotated when force is applied to the shank, and
- (ii) the shank connects together the first said head and said second head.

3. The quad wrench of claim 1, wherein each first certain size of bolt is an SAE bolt and each second certain size of bolt is a metric bolt.

4. The quad wrench of claim 1, wherein each bolt receiving space of each crown is configured to correspond to both a first certain size of bolt and a second certain size of bolt such that when a bolt of either certain size is received in the bolt receiving space and the head the crown is a part of is rotated by applying force to the shank, force is applied to hex flats of the bolt and the bolt is rotated.

5. The quad wrench of claim 1, wherein said internal guide has a constant thickness.

6. The quad wrench of claim 1, wherein said internal guide includes an aperture defined therethrough.

7. The quad wrench of claim 1, wherein each interior face is curved inwards towards a horizontal midpoint.

8. The quad wrench of claim 1, wherein each bolt receiving space of said first crown is at least partially defined by an upper outer surface of said internal guide and some of said plurality of interior faces.

9. The quad wrench of claim 8, wherein said upper outer surface of said internal guide is planar.

10. The quad wrench of claim 1, wherein each bolt receiving space of said second crown is at least partially defined by an upper outer surface of said internal guide and some of said plurality of interior faces.

11. The quad wrench of claim 10, wherein both said upper outer surface and said lower outer surface of said internal guide are planar.

* * * * *